US011788301B2

(12) United States Patent
Fults

(10) Patent No.: US 11,788,301 B2
(45) Date of Patent: Oct. 17, 2023

(54) PLANK FOR WALL OR SURFACE COVERING AND METHODS THEREOF

(71) Applicant: Kevin Fults, Las Vegas, NV (US)

(72) Inventor: Kevin Fults, Las Vegas, NV (US)

( * ) Notice: Subject to any disclaimer, the term of this patent is extended or adjusted under 35 U.S.C. 154(b) by 0 days.

(21) Appl. No.: 17/339,825

(22) Filed: Jun. 4, 2021

(65) Prior Publication Data

US 2021/0381250 A1 Dec. 9, 2021

Related U.S. Application Data

(60) Provisional application No. 63/034,918, filed on Jun. 4, 2020.

(51) Int. Cl.
*E04F 13/08* (2006.01)

(52) U.S. Cl.
CPC ..... *E04F 13/0887* (2013.01)

(58) Field of Classification Search
CPC ... E04F 13/0887; E04F 13/0885; E04F 13/04; E04F 2203/02; E04B 1/7625; E04B 2002/0202
USPC ..... 52/105, 506.05
See application file for complete search history.

(56) References Cited

U.S. PATENT DOCUMENTS 1,702,912 A * 2/1929 McCoy ..... E04F 13/142 52/390
4,079,554 A * 3/1978 Terwilliger ..... E04F 13/0885 428/41.7
4,589,241 A * 5/1986 Volpenhein ..... E04F 13/0862 52/385
4,917,933 A * 4/1990 Schluter ..... E04B 1/762 428/167
4,927,696 A * 5/1990 Berg ..... G01B 3/004 428/195.1
5,062,913 A * 11/1991 Owens ..... C04B 37/008 156/154
5,373,676 A * 12/1994 Francis ..... E04F 13/0862 52/387
5,950,319 A * 9/1999 Harris ..... E04F 21/04 33/494
6,343,451 B1 * 2/2002 Chih ..... E04F 13/0885 52/312
6,539,643 B1 * 4/2003 Gleeson ..... E04C 2/043 33/563
8,555,581 B2 * 10/2013 Amend ..... E04B 1/765 52/302.1

(Continued)

*Primary Examiner* — Brian E Glessner
*Assistant Examiner* — Adam G Barlow
(74) *Attorney, Agent, or Firm* — Connie R. Masters

(57) ABSTRACT

A plank and plank system for covering a wall or other surface is provided. Each longitudinally extending plank comprises a generally planar front façade and a back member. The back member comprises multiple plateaus interspersed with channels. Each plateau provides a flat surface that will be adjacent to the wall/surface when the plank is installed and onto which, optionally, a strip of pressure sensitive adhesive tape may be applied. The channels provide a predetermined location and predetermined holding capacity to regulate the location and amount of construction adhesive to be applied by a user. In an aspect of the invention, the channels also provide a degree of flexibility that allows the plank to adhere securely to the wall and that allows the depth of the plank to be greater than conventional wood wall covering panels.

9 Claims, 21 Drawing Sheets

(56) References Cited

U.S. PATENT DOCUMENTS

2005/0229520 A1* 10/2005 Julton ..... E04F 13/04 52/177
2006/0101751 A1* 5/2006 Oh ..... E04F 13/0885 52/311.1
2006/0107617 A1* 5/2006 Scott ..... E04F 21/22 52/750
2009/0188180 A1* 7/2009 Irvine ..... E02D 29/0233 52/630
2009/0233034 A1* 9/2009 Saunders ..... C09J 7/10 428/41.8
2009/0308001 A1* 12/2009 Wu ..... E04F 13/0885 52/173.3
2010/0095619 A1* 4/2010 Klaus ..... E04F 15/02016 52/390
2010/0325999 A1* 12/2010 Devalapura ..... E04B 1/80 52/506.05
2012/0297697 A1* 11/2012 Schaefer ..... E04F 13/09 52/302.1
2013/0284355 A1* 10/2013 Farrage, Jr. ..... E04F 13/14 156/247
2014/0329062 A1* 11/2014 Song ..... B32B 27/065 428/209
2015/0211236 A1* 7/2015 Bowden ..... E04F 13/0885 428/41.8
2015/0218829 A1* 8/2015 Curtis ..... E04F 13/0873 52/506.05
2015/0233122 A1* 8/2015 Dickey ..... E04F 13/147 52/302.1
2016/0194873 A1* 7/2016 Lillette ..... E04B 1/98 52/745.13
2017/0218635 A1* 8/2017 O'Leary ..... B32B 27/06
2017/0234018 A1* 8/2017 Bovijn ..... A47G 27/0481 52/506.05
2019/0010361 A1* 1/2019 Hoshi ..... C09J 163/00
2019/0032341 A1* 1/2019 Fleet ..... B32B 15/10
2019/0277040 A1* 9/2019 Arcarisi ..... E04F 13/0885
2019/0301172 A1* 10/2019 Palm ..... E04B 2/88
2020/0131783 A1* 4/2020 Liu ..... B32B 27/18
2021/0123242 A1* 4/2021 Palma ..... E04F 13/10
2021/0131115 A1* 5/2021 Fogel ..... B32B 5/02
2022/0056704 A1* 2/2022 Chen ..... B32B 5/245
2022/0081913 A1* 3/2022 Lai ..... E04F 15/206

* cited by examiner

PLANK FOR WALL OR SURFACE COVERING AND METHODS THEREOF

CROSS-REFERENCE TO RELATED APPLICATIONS

This nonprovisional application claims the benefit of U.S. Provisional Patent Application Ser. No. 63/034,918, filed on Jun. 4, 2020, which is incorporated herein in its entirety.

FIELD OF INVENTION

This invention relates generally to building materials, and, more particularly, to a plank of wood or of natural or synthetic material for covering walls or surfaces, to a fabrication system thereof, to installation thereof, and to fastening means thereof.

BACKGROUND OF THE INVENTION

Planks of milled lumber and/or of other natural materials and/or of synthetic materials may be used for covering walls or surfaces to provide both functional and aesthetic enhancement. However, properly and securely attaching planks to a wall or surface presents difficulties. Nailing the planks is undesirable because not only do nail heads detract from the attractiveness of the natural wood grain or other exterior finish, but also the end user (retail customer or construction worker) cannot readily locate the studs (typically supporting the sheet rock wall structure) into which the nails should be driven.

Recognizing this problem, some plank fabricators have created a peel-and-stick paneling adherence system in which double-sided adhesive tape is applied to the back of a plank and covered with a release liner; the end user peels the release liner off to expose the adhesive and then presses the paneling plank onto a wall. Though this is convenient, and no nails or hammers are needed, this conventional peel-and-stick system does not provide a stable, long lasting bond; the planks tend to loosen and separate from the wall over time. Using the peel-and-stick product in areas with high humidity or in areas that experience high temperatures only amplifies the problems to the degree that this conventional product is not satisfactory in all cases.

Another approach to attaching planks to a wall is to use construction adhesive. Typically, a cartridge of construction adhesive is inserted into a manual or powered adhesive gun, and the user extrudes beads of adhesive along the length of the plank. Because the user has no way to determine how much adhesive is needed and has a desire to make certain that the plank remains fastened to the wall, the user typically applies far more adhesive than is necessary. This liberal application wastes the adhesive product. Therefore, it unnecessarily increases the cost of the installation, and it may result in excess adhesive being forced out from the back of the plank to mar the edges of the plank front or oozing out between adjacent planks, which then requires extra time and work for cleanup.

Accordingly, there is a need for a simple and straightforward means and method to install natural or synthetic planks without the use of nails that does not result in adhesive waste.

BRIEF SUMMARY OF THE INVENTION

The present invention is directed to a plank and a plank wall covering system that includes multiple longitudinally extending planks and is directed to methods relating to the plank and plank system. The planks may be formed of milled lumber and/or of other natural materials and/or of synthetic materials and are cut to a specified length, depth, and width.

Each of the planks comprises a generally flat front façade and an opposing back member, which may be formed unitarily or may be formed separately and fixedly joined. The back member comprises multiple plateaus of a prescribed height and interspersed, concave, adhesive-receiving valleys or concavities (termed "channels") that have a predetermined location and define a predetermined volume that is defined by the channel's prescribed width, depth, and length. The size of the channel controls the amount or volume of construction adhesive that is to be applied by the user, because the user applies the adhesive only in the channel and applies only as much as the channel can hold. The end user applies adhesive into all the channels or into a subset of designated channels. The width and depth of the channel into which the adhesive is applied serves as a measurement indicator that facilitates the application of the appropriate amount of adhesive and imposes a limitation on the amount of adhesive applied. The predetermined location compels the user to apply the adhesive in an appropriate location for proper attachment. Thus, the location of the channels and the volume defined by the channel walls serve as a guide in applying the proper amount of construction adhesive to a suitable predetermined location on the back member of the plank.

The predetermined location and predetermined channel width, depth, and length are established through testing or calculations to be a satisfactory location for adhesive application and to hold a sufficient amount of adhesive for proper adherence of the plank onto the surface.

Thus, the inventive plank with a volume-controlled and location-controlled adhesive disbursement and application system provides a simple and straightforward means and method to install natural or synthetic planks without the use of nails that does not result in adhesive waste and does not result in excess adhesive being extruded from behind the plank onto the front edges of the plank or between adjacent planks.

One channel or a set of channels may be disposed between the plateaus or between a plateau and the plank edge; or shorter channels may be interspersed within the plateau or plateaus. In an aspect, one or more plateaus are crowned with pressure-sensitive adhesive tape.

In another embodiment of the invention, the plank is formed from stiff material, such as wood, which is preferably reclaimed wood. In this embodiment, besides the advantage of placement and quantification of the adhesive, the channel and plateau design (including channels and/or sets of channels) causes the rigid plank to have flexibility, allowing it to adapt to undulations in the wall or surface to which it will be applied, which results in stronger and longer lasting adhesion.

The aspect in which lumber is reclaimed from dilapidated barns, homes, and other buildings has great appeal to consumers because rescuing and repurposing wood has environmental advantages. The recycling of reclaimed lumber reduces deforestation, increases animal habitats for native species, and reduces energy consumption compared to harvesting new timber. Reclaimed lumber, which may even be from unobtainable virgin growth trees, has beautiful grain patterns that can be revealed upon milling and that can add beauty to a home. These eco-friendly and visually appealing features make reclaimed wood highly desirable. However, reclaimed lumber from dilapidated structures is by its very nature inconsistent in width, length, and thickness, uneven and jagged, and often marred by holes, nails, and embedded debris. In this aspect of the invention, a method of processing the reclaimed lumber is disclosed that allows consumers and professionals in the construction trade to effectively use it. This includes methods of milling the reclaimed lumber to consistent dimensions, as well as channel and plateau design methods to limit the location and volume of adhesive applied, as well as to add flexibility to the plank panels to allow conformation to an imperfect wall and to eliminate unadhered pockets behind areas of the plank paneling that could cause the ends of the planks to spring outward. These problems with attachment have typically been addressed by making the wood paneling boards very thin, which gives a degree of flexibility, but sacrifices robustness and durability. The disclosed method of adding channels to the back member of the plank solves both the problems of flexibility and of proper adherence, while enabling the plank to be deeper and more robust.

In this aspect, when fabricating the wood plank, reclaimed lumber is dimensioned and the channels are cut. Though the front façade of the reclaimed wood plank is generally flat (which may have wood grain, and therefore, may not be truly flat or smooth), the back member of the plank is not. The channels on the back member of the panel produce a flexibility within the plank, allowing the plank to flex slightly to conform to and adhere to uneven walls, while presenting a visually generally flat façade. In an aspect, strips of pressure sensitive adhesive tape are applied to all or most of the multiple plateaus. In an additional aspect of the invention the ends of the plank are perforated. A set of planks is then packaged for shipping to retail stores, directly to do-it-yourself consumers, or to members of the construction trade. The user then applies the proper amount of construction adhesive in the proper location, which allows the installation of the planks even in high humidity and high temperature settings.

In one aspect of the invention in which both pressure sensitive tape and adhesive-receiving channels are included, to use the wood plank wall paneling system, the user applies adhesive into the channels, removes the release liner from the tape, and adheres the plank to the wall.

In a further aspect of the invention in which adhesive-receiving channels are included but no pressure sensitive tape is involved, to use the wood plank wall paneling system, the user applies adhesive into the channels and adheres the plank to the wall.

In an additional aspect of the invention, the plank is configured with a set of multiple rows of regulating delineations on at least one end of the plank and preferably on both ends of the plank. These regulating delineations may be rows of perforations, cuts, partial cuts or the like that facilitate shortening of the plank either by the fabricator or the end user, and that also relieve pressure within the wood fiber.

In a further aspect of the invention, the plank is configured with regulating delineations on both ends of the plank.

In an additional aspect of the invention, the plank is configured with regulating delineations on only one end of the plank.

In a further aspect of the invention, the plank has no rows of regulating delineations.

In another aspect of the invention, the regulating delineations comprise rows of perforations.

In a further aspect of the invention, the regulating delineations comprise rows of partial cuts.

In an additional aspect of the invention, the regulating delineations comprise rows of cuts.

In one aspect of the invention, the plank is configured with channels of a single depth.

In another aspect of the invention, the plank is configured with channels of multiple depths.

In an additional aspect of the invention, the plank is configured with multiple channel sets, with at least one channel sets comprising a plurality of channels and with at least one channel sets comprising a single channel.

In another aspect of the invention, the plank is configured with multiple channel sets, with each channel set comprising a plurality of channels.

In a further aspect of the invention, the plank is adhered to the wall or surface using only the pressure sensitive adhesive tape without the use of construction adhesive.

In an additional aspect of the invention, the plank is adhered to the wall or surface using both the pressure sensitive adhesive tape and, also, construction adhesive applied by the end user into one or more channels.

In another aspect of the invention, all the channels on the back member of the plank are to be filled with adhesive.

In a further aspect of the invention, only a designated portion of the channels on the back member of the plank are to be filled with adhesive.

An object of the invention is to provide a plank wall covering system and methods of manufacturing and of use that gives an improved performance over the above-described prior art systems and methods.

These and other objects, features, and advantages of the present invention will become more readily apparent from the attached drawings and from the detailed description of the preferred embodiments which follow.

BRIEF DESCRIPTION OF THE SEVERAL VIEWS OF THE DRAWINGS

The preferred embodiments of the invention will hereinafter be described in conjunction with the appended drawings, provided to illustrate and not to limit the invention, where like designations denote like elements.

Like reference numerals refer to like parts throughout the several views of the drawings.

DETAILED DESCRIPTION OF THE INVENTION

Figure 1:
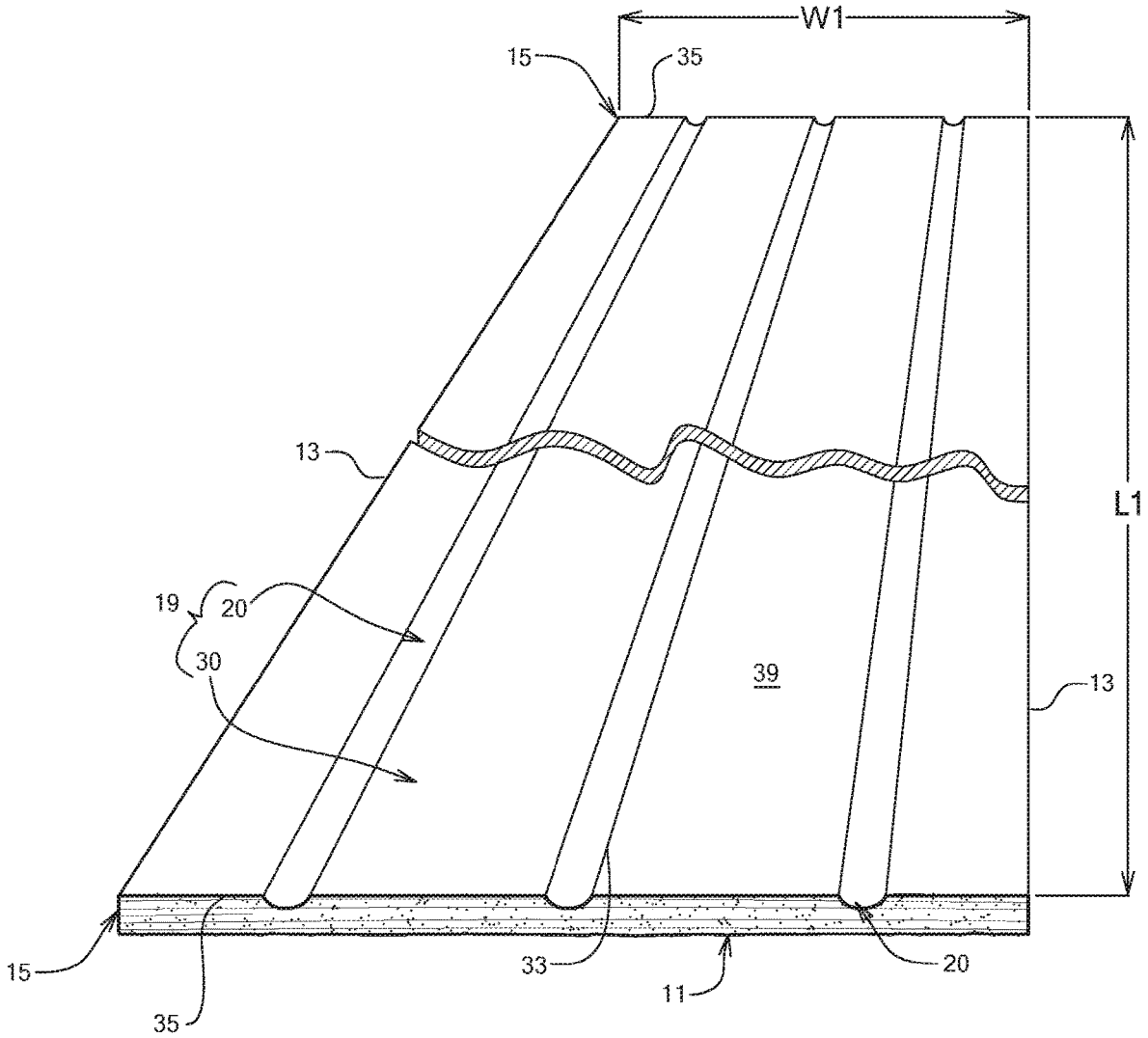
FIG. 1 is a back perspective view of the plank of a first embodiment of the present invention.

Shown throughout the figures, the present invention is directed toward a plank 10 of natural or synthetic material, toward a plank system for covering a wall or other surface, and toward methods of creation, installation, and fastening of the plank to a wall or surface. Though referred to as a decorative wall covering system, it will be apparent to those skilled in the art that the plank system can be applied to other flat surfaces, such as flat surfaces of furniture (such as headboards, dressers, office furniture), stair risers, other architectural features, and the like. And, although illustrated as a wood plank, planks formed of other materials are within the scope of the invention.

In all the embodiments, the plank 10 extends laterally between opposing lateral edges 13 and extends longitudinally between opposing longitudinal ends 15. The plank 10 comprises a decorative front façade 11 and an opposing plank back member 19. which may be created separately and fixedly joined or may be fabricated unitarily.

The plank back member 19 comprises flat plateaus 30 and multiple channels 20, which are concavities within the rearward surface of the back member 19. The plateaus 30 function to provide a level surface that will be adjacent to the wall or surface after installation of the plank 10 and, in an aspect of the invention, onto which pressure-sensitive tape 50 (FIGS. 8-11) is adhered.

Figure 12:
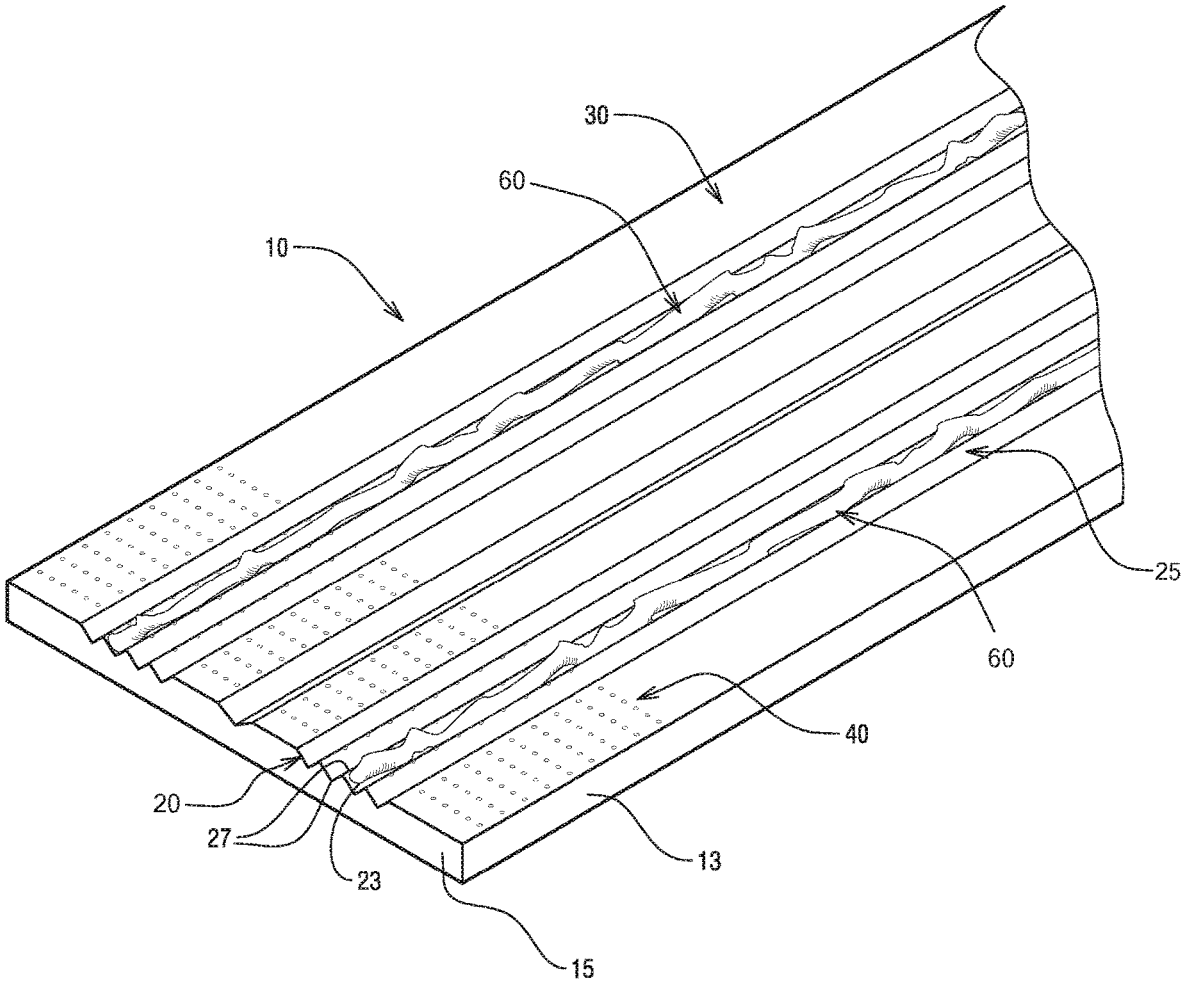
FIG. 12 is a partial perspective view of the plank of FIG. 9 including applied construction adhesive.
Figure 13:
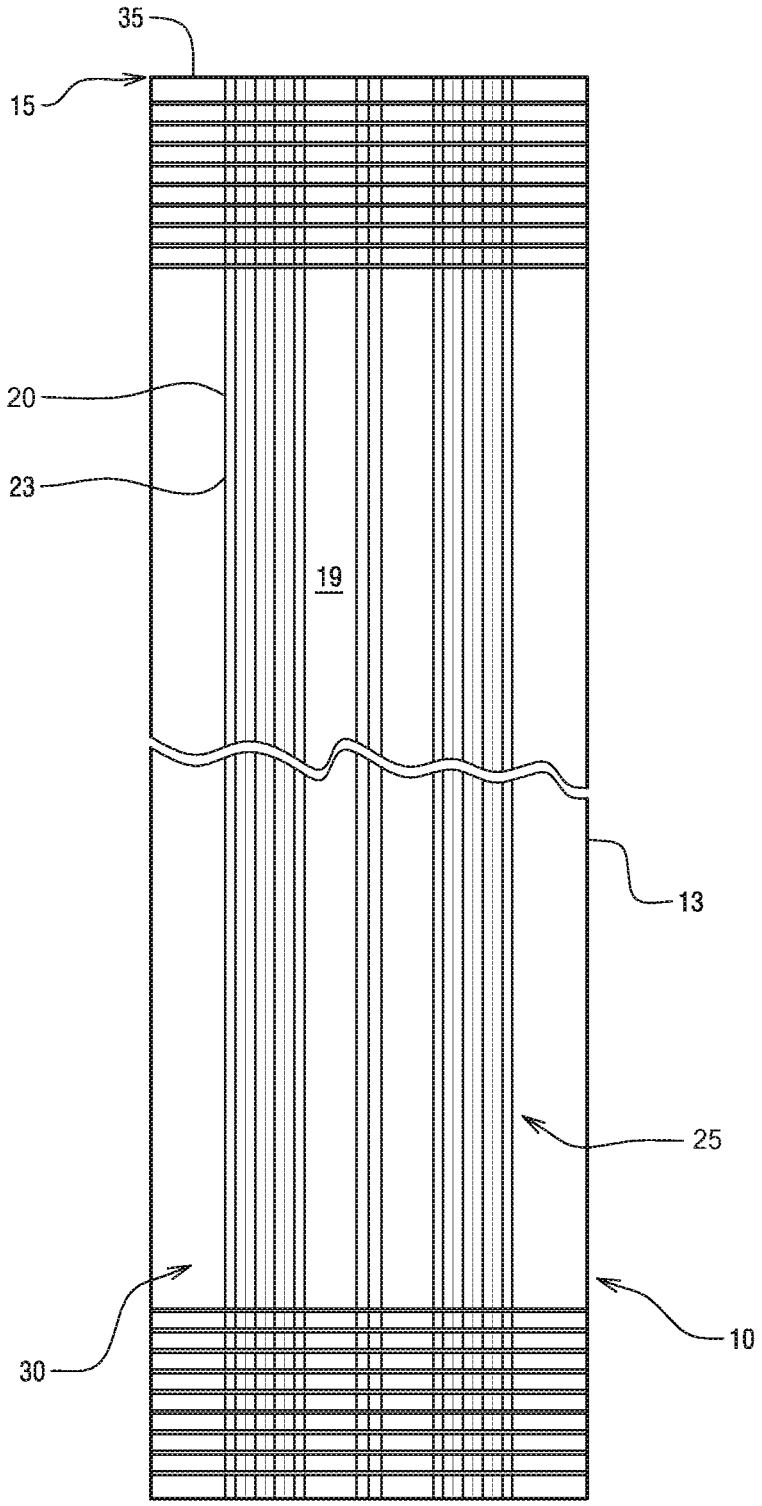
FIG. 13 is a back view of a sixth embodiment of the plank of the present invention showing partial cut-type regulating delineations.
Figure 14:
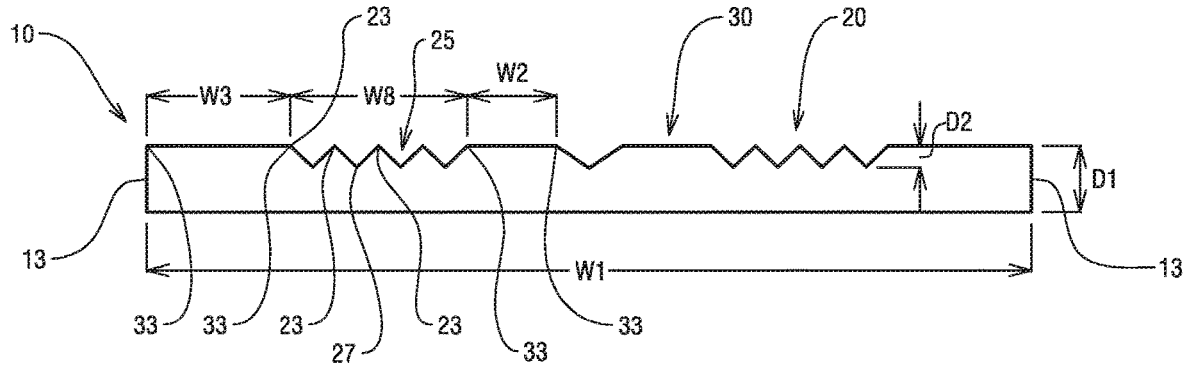
FIG. 14 is an end view of the plank of an embodiment of the invention showing a channel set aspect.
Figure 15:
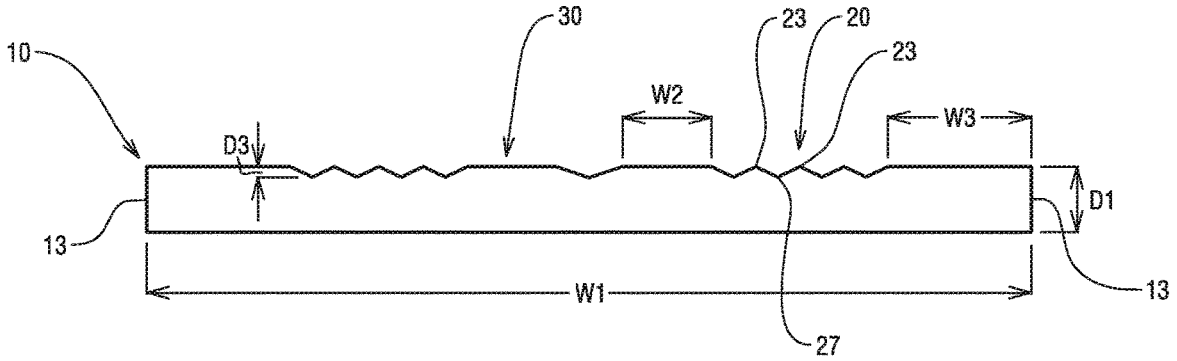
FIG. 15 is an end view of the plank of an embodiment of the invention showing a channel set aspect.

The inset, concave channels 20 function to guide the application of construction adhesive 60 (FIG. 12). They serve as a measurement framework, because the length, width, and depth of a channel 20 define a concave void with a predetermined volume, which is to receive a specific, proper amount of construction adhesive 60. The channels 20 are positioned to indicate the predetermined location at which the adhesive 60 is to be applied and are sized to specify the volume or amount of adhesive that is needed. The specific location and volume are predetermined through testing and/or calculations. Thus, the channels 20 function to guide the end user to apply the adhesive 60 in a suitable location and to apply the correct amount of adhesive 60. The planned, prescribed capacity of the channel 20 is equal to the proper volume or amount of the adhesive 60, thus simplifying and standardizing the volume of adhesive 60 to be applied to the back member of the plank 10, which reduces adhesive wastage.

In one aspect of the invention, the construction adhesive 60 is spread into all the multiple channels. In another aspect, such as in FIGS. 8-17 in which the channels serve both to specify the location and volume of adhesive as well as to enhance the flexibility of the plank 10, the adhesive is applied into only a designated subset of the multiple channels. In either aspect, a line or bead of adhesive is spread by the user into a channel 20 on the back member of the plank before pressing the plank 10 onto the wall/surface.

Figure 2:
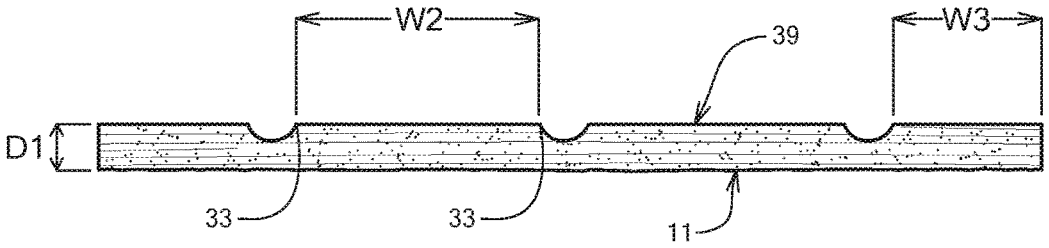
FIG. 2 is an end view of the plank of FIG. 1.

As seen in the back perspective view of FIG. 1 and the end view of FIG. 2, the plank 10 extends longitudinally a predetermined length L1 between opposing plank ends 15, extends laterally a predetermined width W1 between opposing plank lateral edges 13, and extends a predetermined depth D1 (FIG. 2) between the surface 39 of the back member plateau 30 and the frontmost portion of the opposing front decorative and/or grained façade 11. The predetermined length, width, and depth of the plank 10 may be varied based on factors such as the original length and width of the lumber or material used, the specific application for which the finished product is designed, consumer preferences, packaging constraints, transportation considerations, and other factors. In an example, the length L1 may be between 2 and 20 feet, the width W1 may be in the range of 4 to 20 inches, and the depth D1 may be in the range of ⅛ inch to 1 inch.

In the embodiment seen in FIGS. 1-2, multiple plateaus 30 extend longitudinally between plateau ends 35 a length L1, which is the full the length of the plank 10. The plateau 30 extends an intermediary width W2 (FIG. 2) between plateau lateral edges 33 or a border width W3 (FIG. between a plateau lateral edge 33 and the plank edge 13. Though in FIGS. 1-2 the intermediary widths W2 are substantially equal to each other, in other aspects of the invention, the intermediary widths W2 are not equal. Similarly, though the border widths W3 are shown as equal to each other in FIGS. 1-2, they may or may not be equal. In the aspect shown in FIGS. 1-2, lateral edges 33 of the plateaus coincide with the edge 13 of the plank. However, in another aspect, the plateau lateral edges 33 are interior of the lateral edges 13 of the plank, as in FIGS. 16 and 17.

Figure 16:
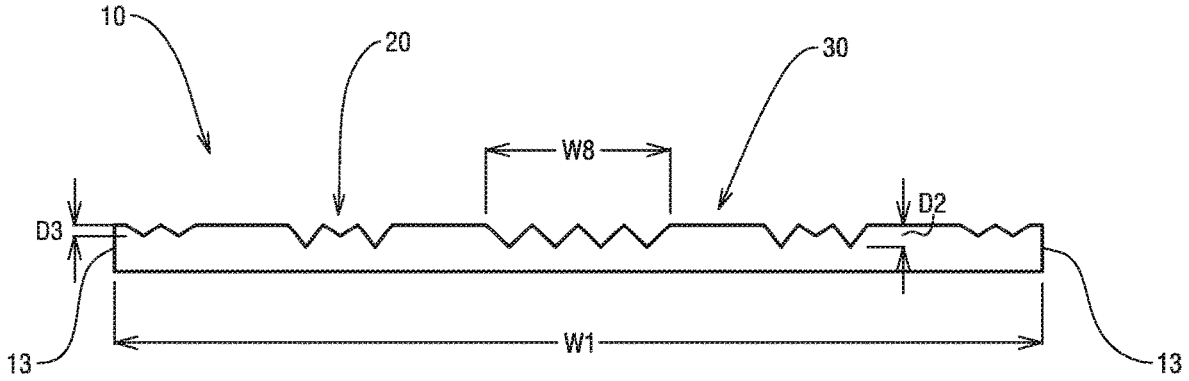
FIG. 16 is an end view of the plank of an embodiment of the invention showing a channel set aspect.
Figure 17:
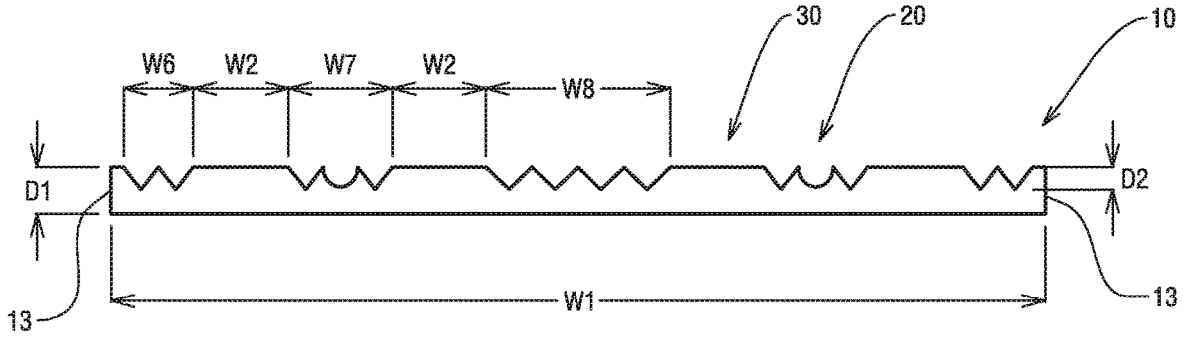
FIG. 17 is an end view of the plank of an embodiment of the invention showing a channel set aspect.
Figure 18:
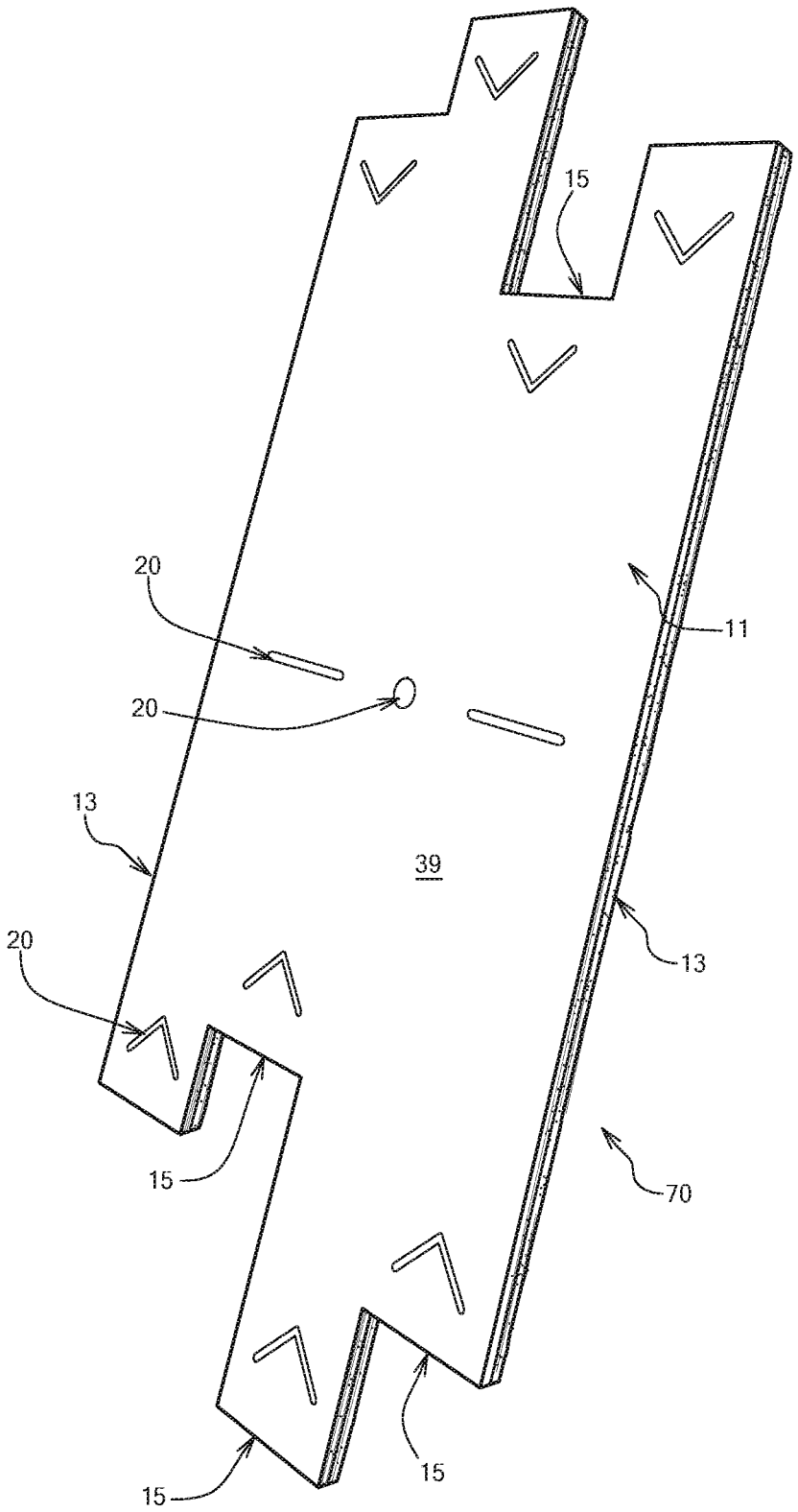
FIG. 18 is a back perspective view of a seventh embodiment of the plank of the present invention showing a larger, enhanced plank.
Figure 19:
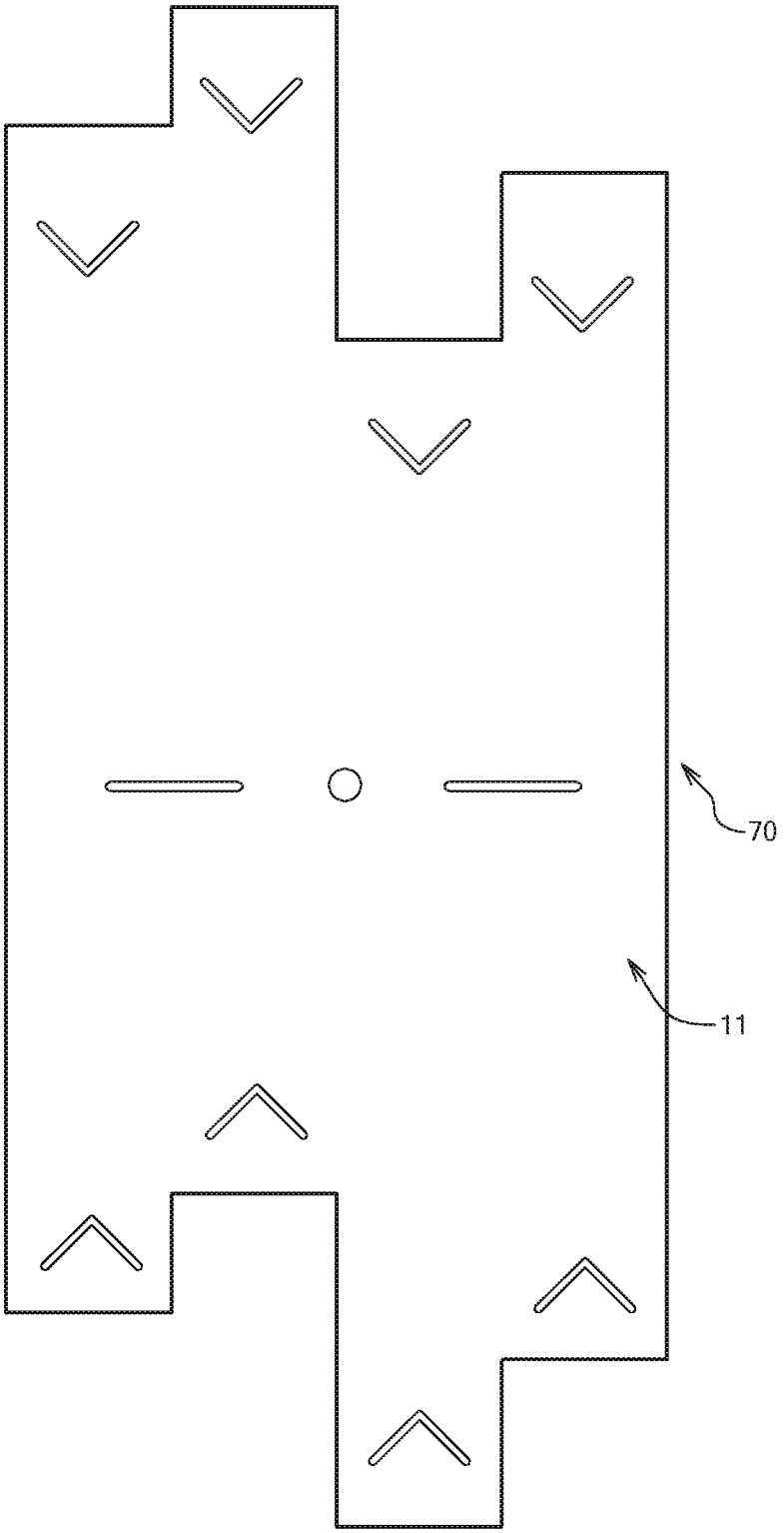
FIG. 19 is a back view of the enhanced plank of FIG. 18.

In the aspect of FIGS. 1-2, the channels 20 are of substantially equal depth D1; however, in other aspects, the channels 20 may not be of equal depth, such as, for example, in FIG. 16.

In this and all other embodiments, each plateau 30 has a substantially flat extent, surface 39, which is a level surface that will be juxtaposed against the wall/surface during installation. The flat surfaces 39 of the plateaus 30 are substantially planar. In an aspect of the invention, the plateau surface 39 also functions to receive a lane or strip of double-sided pressure sensitive adhesive tape 50. The number, width, and placement of the plateaus 30 may vary based on factors such as the width of the pressure-sensitive tape 50 to be applied, the need for more tape or less tape 50, the need for more channels or less channels 25, the width of the planks 10, and similar factors.

In this and all other embodiments, although the front surface of the façade 11 may be visually perceived as flat or smooth upon a cursory viewing, the façade front may be slightly irregular, such as would be the case if the façade has exposed wood grain or a textured outer finish.

In the first embodiment of FIGS. 1-2, the plank 10 includes three channels 20 disposed between four plateaus 30. The channels 20 are long, narrow U-shaped cuts or indentations in the back member 19 of the plank 10 that extend the length L1 of the plank 10. In this embodiment, each of the channels 20 have the same channel depth D2.

Figure 3:
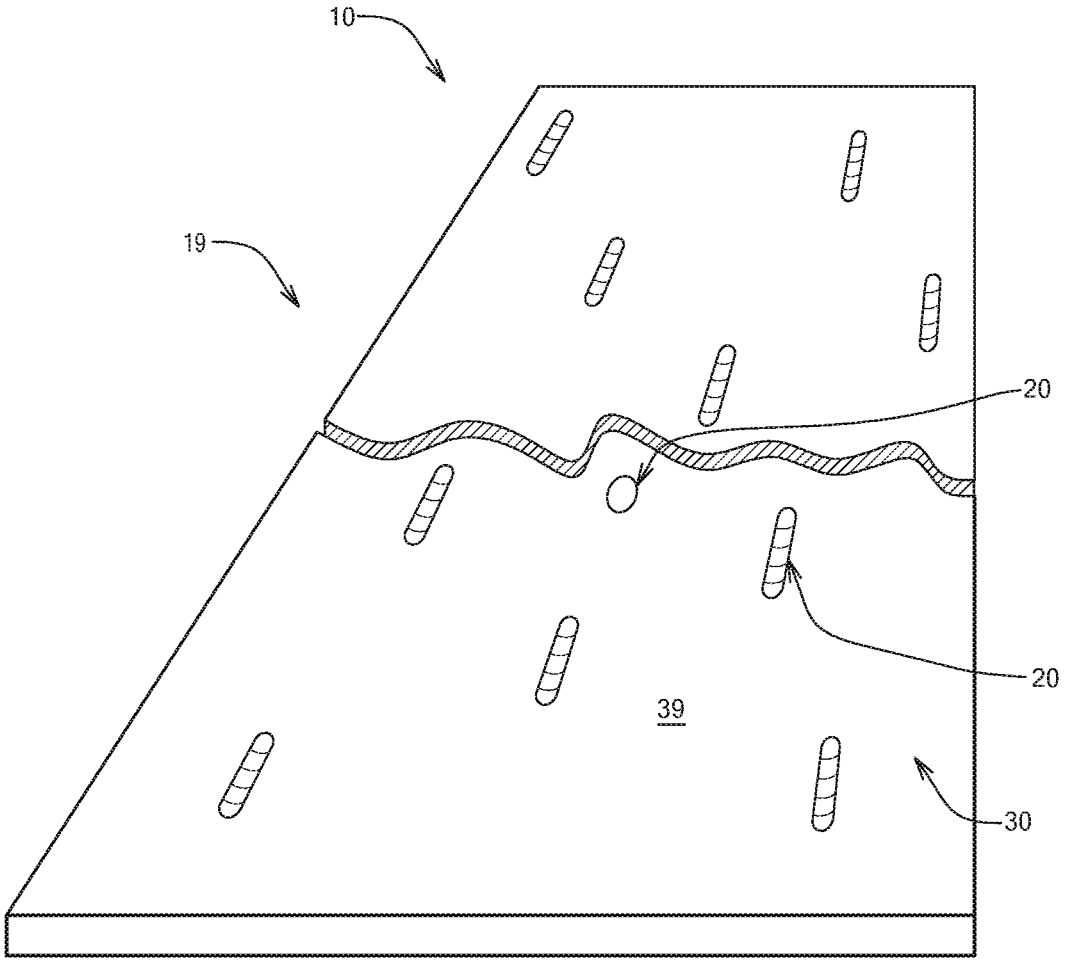
FIG. 3 is a back perspective view of the plank of a second embodiment of the present invention.
Figure 4:
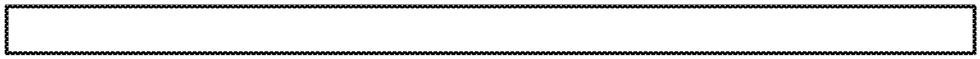
FIG. 4 is an end view of the plank of FIG. 3.

In the second embodiment of FIGS. 3-4, the concave channels 20 do not extend the length of the plank, but instead they are concavities distributed periodically along the back member 19 of the plank 10. FIG. 3 shows that the channel 20 may take the form of a short, slender depression or may be in the shape of an oval trough or a circular concavity. These shaped channel designs are used to limit the amount and identify the location of the adhesive application. For example, in instances when the volume of a full-length channel (as shown in FIG. 1) defines a volume of adhesive that is greater than necessary or desirable, the fabricator of the plank can reduce the volume defined by the channel by using short linear, oval, or circular channels as shown in FIG. 3.

Figure 5:
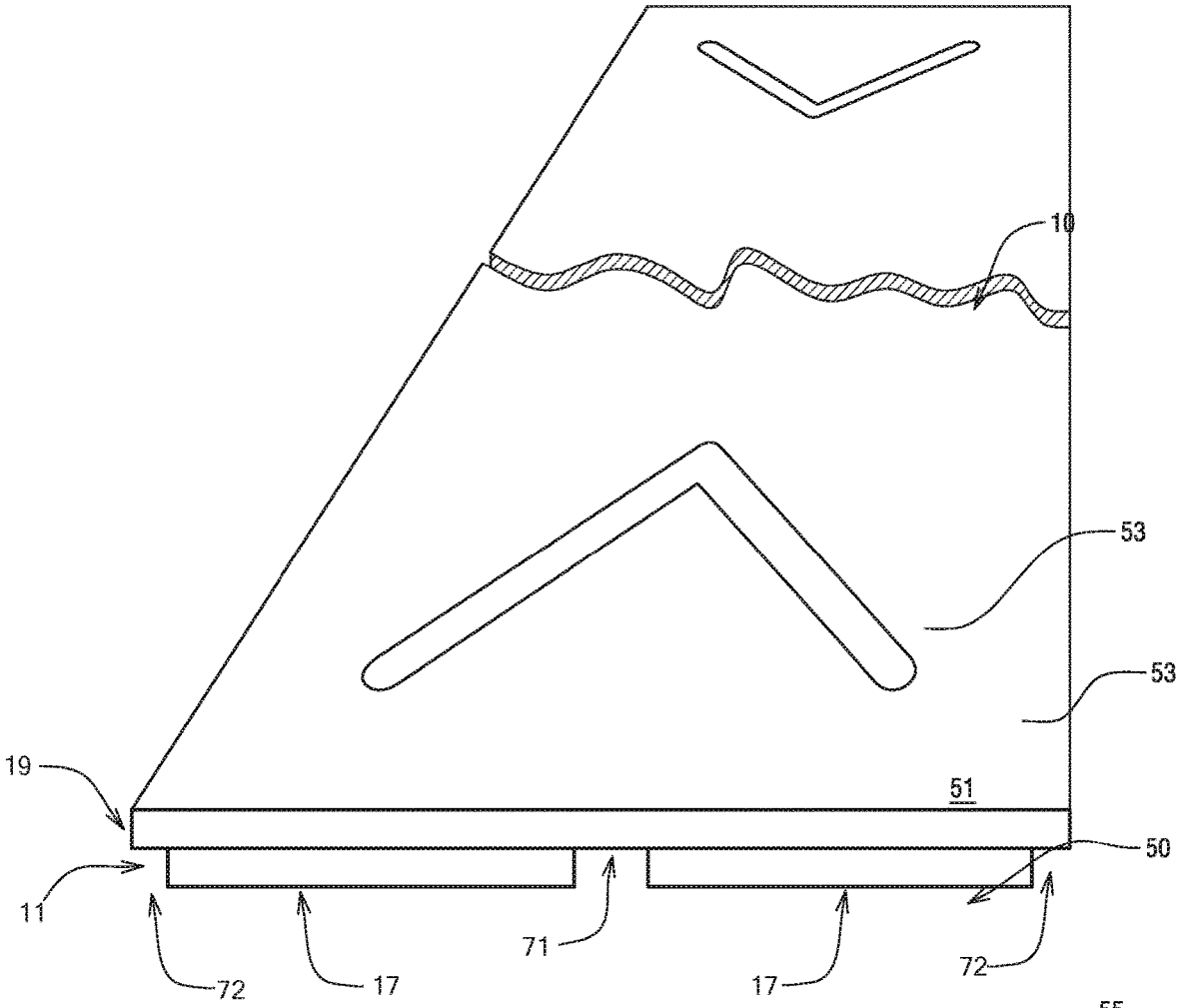
FIG. 5 is a back perspective view of the plank of a third embodiment of the present invention.
Figure 6:
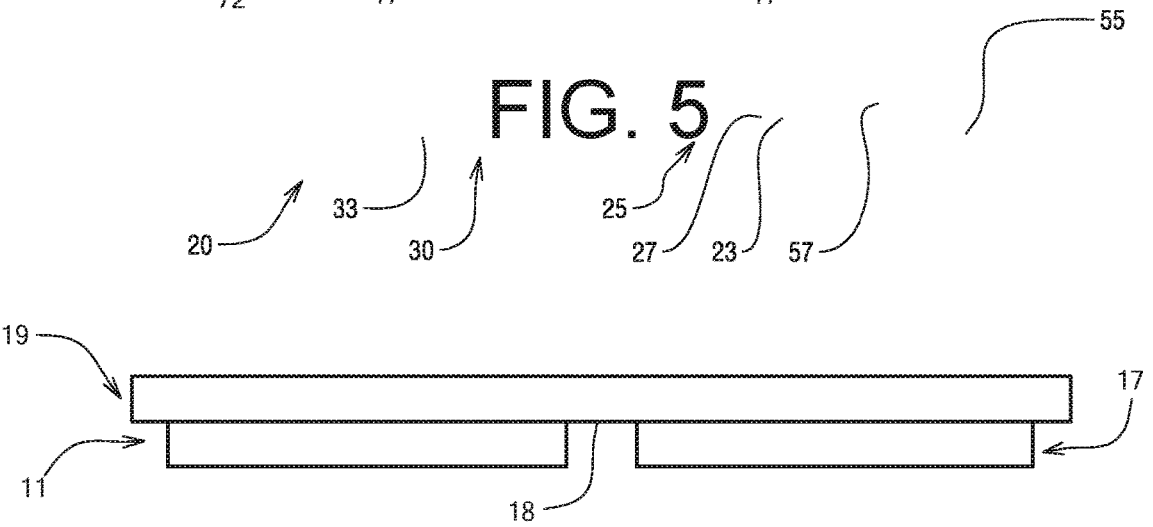
FIG. 6 is an end view of the plank of FIG. 5.
Figure 7:
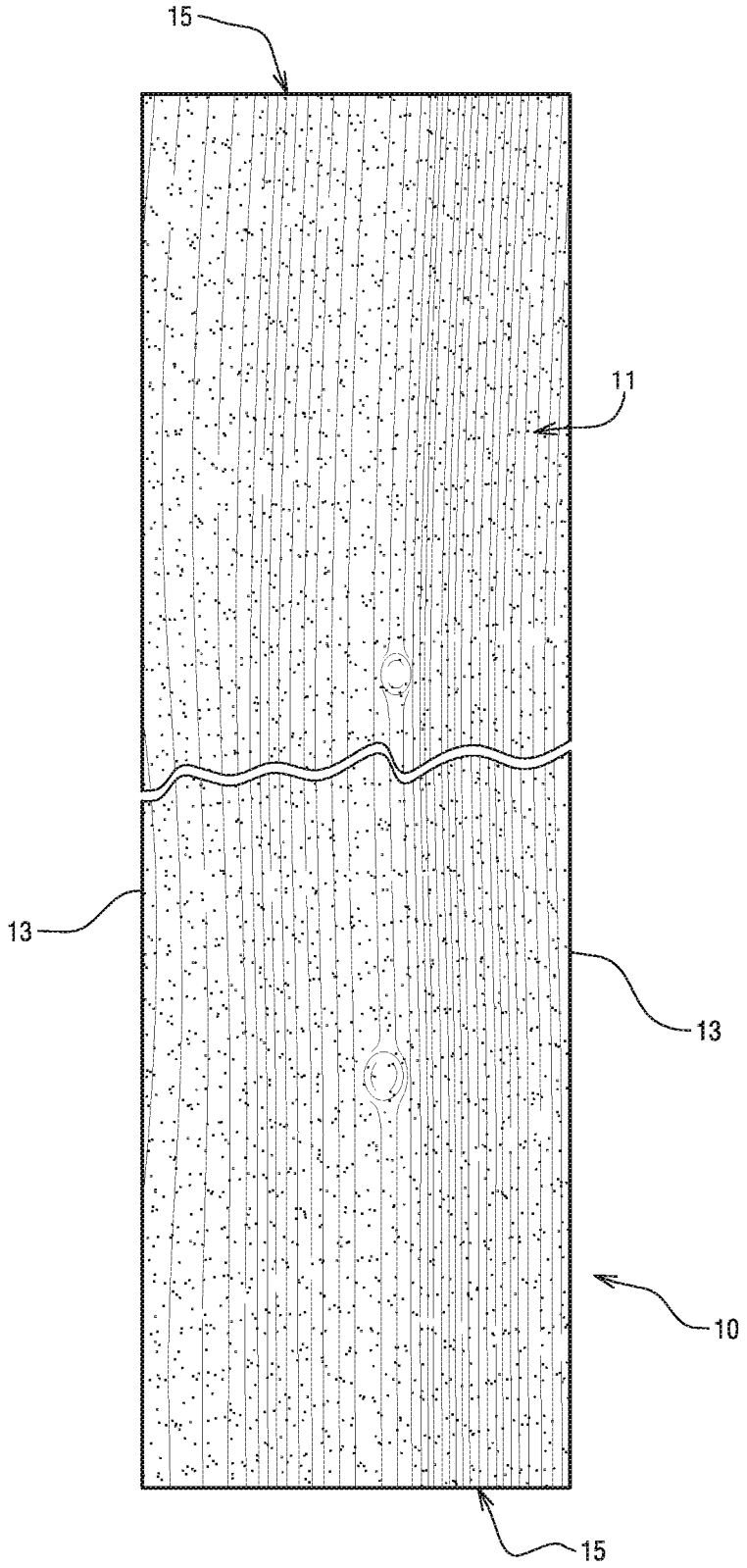
FIG. 7 is a front view of the plank of the first to sixth embodiments of the present invention.
Figure 8:
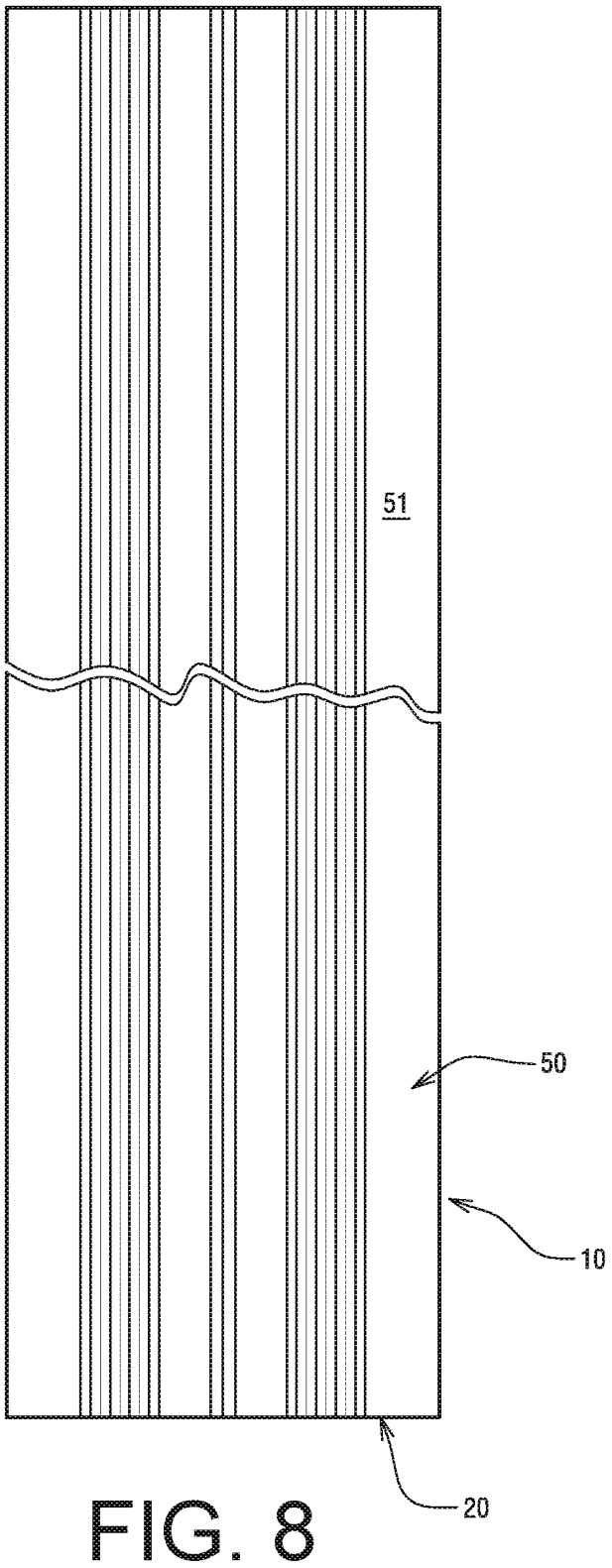
FIG. 8 is a back view of a fourth embodiment of the plank of the present invention including applied pressure sensitive adhesive tape.
Figure 9:
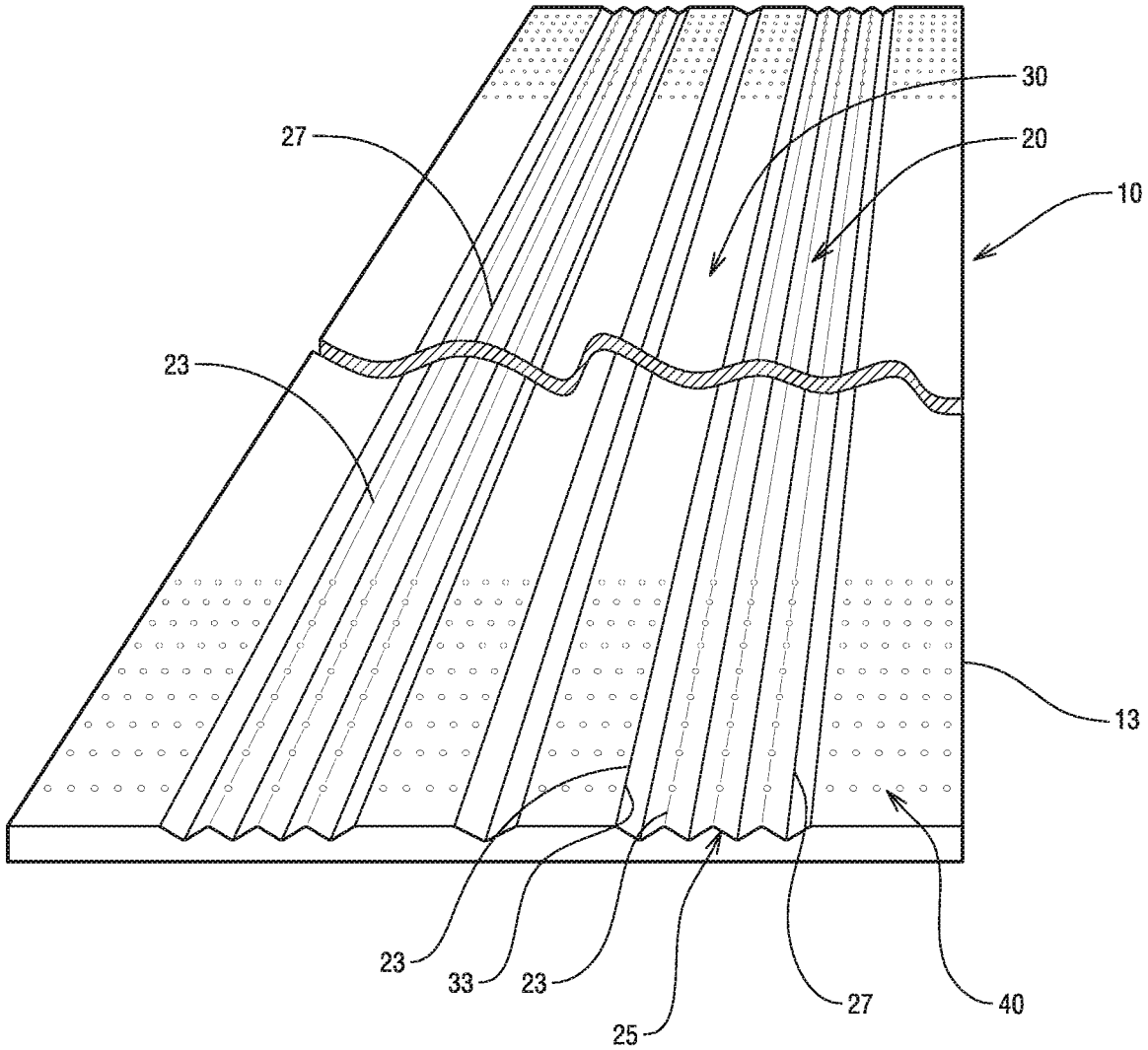
FIG. 9 is a back perspective view of a fifth embodiment of the plank of the present invention without applied pressure sensitive adhesive tape.

In the third embodiment of FIGS. 5-6, the concave channels 20 do not extend the length of the plank as in the first embodiment. Instead, the ends of two straight, narrow channels join together to form a V-like trough formation. One V-type channel formation is disposed near at least each end of the plank 10, and, if the plank is longer, one or more V-type channel formations may be disposed at one or more intervening locations on the back member 19 of the plank 10. The V-shaped trough formation is used to limit and regulate the predetermined volume and predetermined location of the adhesive application. The V-shaped trough formation may have advantages over the full-length channels of FIG. 1, because less volume of adhesive is specified by the volume of the V shape. The V-shaped trough formation may have advantages over the short channels of FIG. 3, in that it may be easier for an end user to run a bead of adhesive into the two connected short channels of the V-shape than to run a bead of adhesive in the disconnected short channels of FIG. 3.

FIGS. 5-6 also disclose another aspect of the invention in which the plank façade 11 does not completely cover the plank back member 19. This is in contrast to the first two embodiments in which the plank façade 11 extends laterally and longitudinally a distance equal to the lateral width and longitudinal length of the back member 19. In this aspect of FIGS. 5-6, the plank façade 11 is shorter laterally than the back member 19 thereby creating a longitudinally extending plank façade strip 17 of material that allows a longitudinally extending, forward-facing section 18 of the back member 19 to show, when the plank is applied to a surface.

In this aspect, the façade 11 may comprise one or multiple front members 17. The front member(s) 17 and the plank back member 19 may be formed separately and fixedly attached to each other, or the front member(s) 17 and the back member 19 may be integrally formed. In this aspect, at least one interior opening 71 or one side opening 72 is defined by the laterally shortened façade 11. An interior opening 71 is disposed between portions of the front member 17 or between multiple front members 17 to provide a decorative enhancement. A side opening 72 is disposed at the lateral edge of the front member 17 and appears as a notch when viewed from the end as in FIG. 6. A side opening 72 of one plank will be adjacent to the side opening of a second plank to form an interesting inset pattern in which the forward-facing section 18 of the back member 19 is seen from the front. When two side openings 72 are paired with an interior opening 71, as shown in FIGS. 5-6, upon installation of adjacent planks, the two adjacent side openings 72 will have a width equal to the interior opening 71, which creates an attractive, repetitive ornamental pattern.

In the embodiments of the invention shown in the FIGS. 8-17, sets 25 of multiple channels 20 are disposed between the plateaus 30. The channel sets may be of equal widths (width W8 of FIG. 14) or may not be of equal widths (widths W6, W7, W8 of FIG. 17).

The channels of the sets 25 serve two purposes: to serve as a measurement framework (as in the first three embodiments) and to additionally enhance the flexibility of the rigid plank 10. Because the channel sets 25 increase the pliability of the plank, the stability of the plank once adhered to a wall is increased. Additionally, the increase in flexibility allows the plank to have a depth greater than conventional peel-and-stick plank products, thus increasing the strength of the plank.

Though shown in the illustrations with the channel and plateau system applied to reclaimed wood planks, this system can be used to provide flexibility for other rigid materials including new wood, composite products, and synthetic planks.

In an aspect of the invention, the channels 20 are of equal depth. In a further aspect of the invention, shown in FIG. 16, the channels 20 are not of equal depth, but some channels 20 are shallower and some are deeper. In this aspect, some of the channels 20 in a plank design may have one channel depth D2 and other channels 20 of the channel sets 25 may have a second channel depth D3. In a single set 25 of channels or in all the channel sets 25, the channels may have the same depth or may vary in depth, which may be determined based on, for example, balancing the need for flexibility, the desire for a thicker more robust product, and the depth that is possibly obtainable from the reclaimed wood stock.

In contrast to the U-shaped channels of the first through third embodiments, the channels in these embodiments are V shaped. Each channel has an upper edge or peak 23 and a low point or floor 27. In sets of multiple channels, a peak 23 is disposed between adjacent channels 25 and the peak 23 at the outer edge of the set of channels may coincide with the lateral edge 33 of a plateau or may coincide with the edge 13 of the plank 10.

Figure 10:
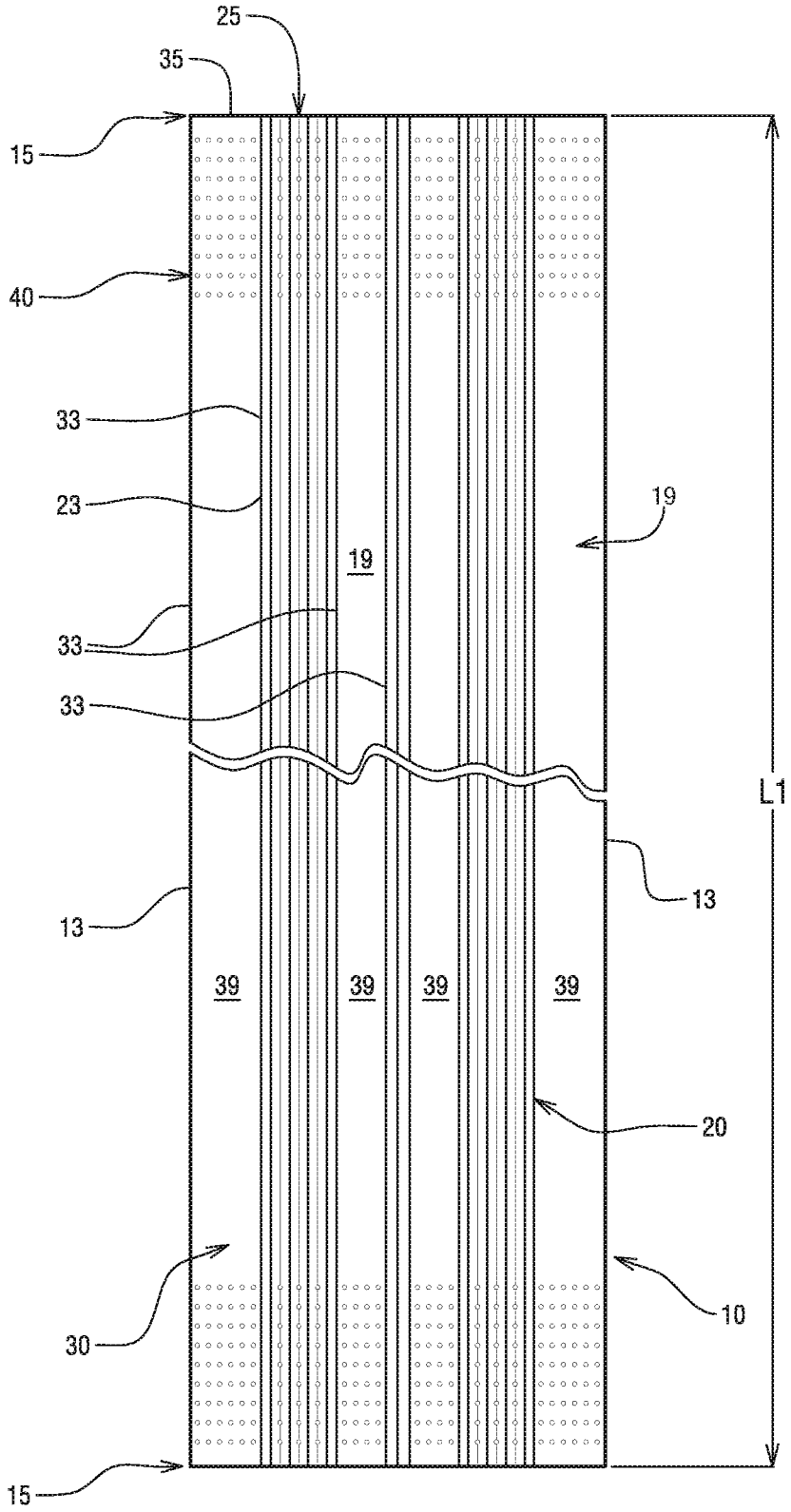
FIG. 10 is a back view of the plank of FIG. 9.
Figure 11:
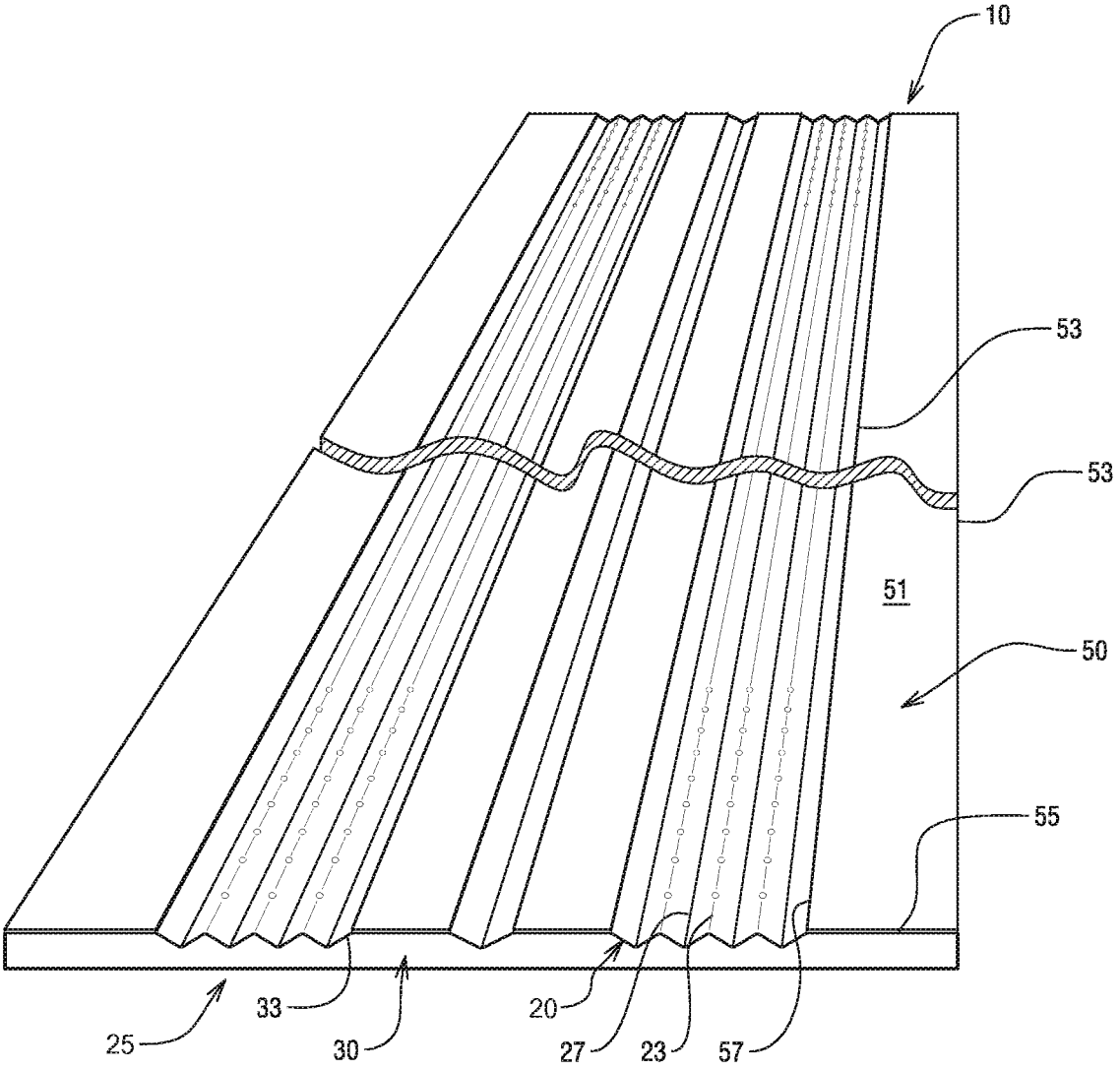
FIG. 11 is a back perspective view of the plank of FIG. 9 including applied pressure sensitive adhesive tape.

In the fifth embodiment of the invention shown in FIGS. 9-12, the plank 10 is similar to the earlier embodiments, but further comprises regulating delineations 40. The regulating delineations 40 are multiple perforations, cuts, partial cuts, or the like that are arranged in laterally extending, linear rows or lines near the ends 15 of the plank 10 and perpendicular to the plateaus 30 and channels 20. The regulating delineations are shown in FIG. 10-12 as perforations and are shown in the sixth embodiment of FIG. 13 as partial cuts.

The regulating delineations 40 serve multiple functions. The sets of regulating delineations 40 serve to reduce or regulate the tension in the membrane within the wood of the plank. They give the fabricator and/or the end user a guide to reduce or regulate the length of the plank 10 by creating a sharp, blunt cut when shortening the plank 10. They also reduce the physical effort required to make the crosscut.

Each regulating delineation 40 comprises a row of multiple perforations, cuts, partial cuts, or the like that are aligned along a straight line extending laterally between the opposing lateral edges 13. In one aspect of the invention, sets of the regulating delineations 40 are disposed on each opposing end 15 of the plank 10. In another aspect of the invention, a set of regulating delineations 40 are disposed on only one end 15 of the plank 10, and the opposing end of the plank 10 is not configured with regulating delineations 40.

In an aspect, after fabrication of the plank, a strip of pressure sensitive adhesive tape 50 (FIGS. 8, 11) is applied to a plateau 30, and preferably multiple plateaus 30 each receive a strip of pressure sensitive adhesive tape 50. This application is preferably performed by the fabricator but can optionally be performed by the end users.

The pressure sensitive adhesive tape is a continuous flexible strip of a carrier 57 (such as cloth, paper, metal, or plastic) coated on both sides with an adhesive that is permanently tacky at room temperature, which will adhere to a variety of surfaces with light pressure (such as finger pressure). The adhesive can be blends of natural or synthetic rubber and resin, acrylic, silicone, or other polymer systems, with or without additives. Adhesive (both inner tape-to-plank adhesive and outward plank-to-wall adhesive) is applied to both sides of the carrier. The inner and outward adhesives on opposing sides of the carrier may be materials having the same or different chemistries and the same or different coating thicknesses. The carrier may preferably be a non-woven cloth or polymeric film such as 0.5 mil polyester. A release liner 51 covers the outward plank-to-wall adhesive and extends laterally between release liner lateral edges 53 and release liner ends 55. It is commonly paper coated on both sides with silicone release agents to create a differential release. The pressure sensitive adhesive tape may or may not include a reinforcement layer.

The inner adhesive on the underside side of the carrier of the pressure-sensitive tape is firmly pressed against the plank 10. Preferably, the outer, rearward surface of the plank-to-wall adhesive is covered by a release liner, which is not removed until the plank 10 is to be installed. This prevents the to prevent the plank-to-wall adhesive from sticking to unintended objects before the time that it is desired to be removed by the end user for affixing the plank onto the wall or other surface. Thus, before installation of the plank, the inner adhesive is sandwiched between the rearward side of the plank and the tape carrier material, and the outward plank-to-wall adhesive is sandwiched between the tape carrier material and the release lining.

The seventh embodiment of the invention of FIGS. 18-24 discloses an enhanced plank 70, which, as in the earlier embodiments, comprises at least one plateau 30 and multiple channels 20. However, the enhanced plank 70 has a greater length and/or width than the plank 10 of the earlier embodiments. Therefore, a greater square footage of the wall or surface is covered when a single enhanced plank 70 is installed compared to the square footage covered by the smaller plank 10. Due to the larger coverage area, the enhanced plank 70 may provide advantages in speed and efficiency of installation, yet still provides guidance to the user by regulating and standardizing the location of adhesive application and the volume of adhesive that will be applied. Due to the greater length and width, which leads to a heavier piece, the façade 11 and the back member 19 may have a depth that is greater than the depth of the plank 10 of the earlier embodiments. As in the other embodiments, the façade 11 and the back member 19 may be formed as one piece or formed separately and joined.

In the earlier embodiments, the both the plank lateral edges and the plank ends 15 were straight. In contrast, in this embodiment, the plank ends 15 are not straight. Instead, both plank ends are formed of multiple parallel end portions that are offset from one another, as illustrated. This discontinuity within the plank ends helps to hide the joints between multiple planks 70 and may also be aesthetically pleasing.

Figure 20:
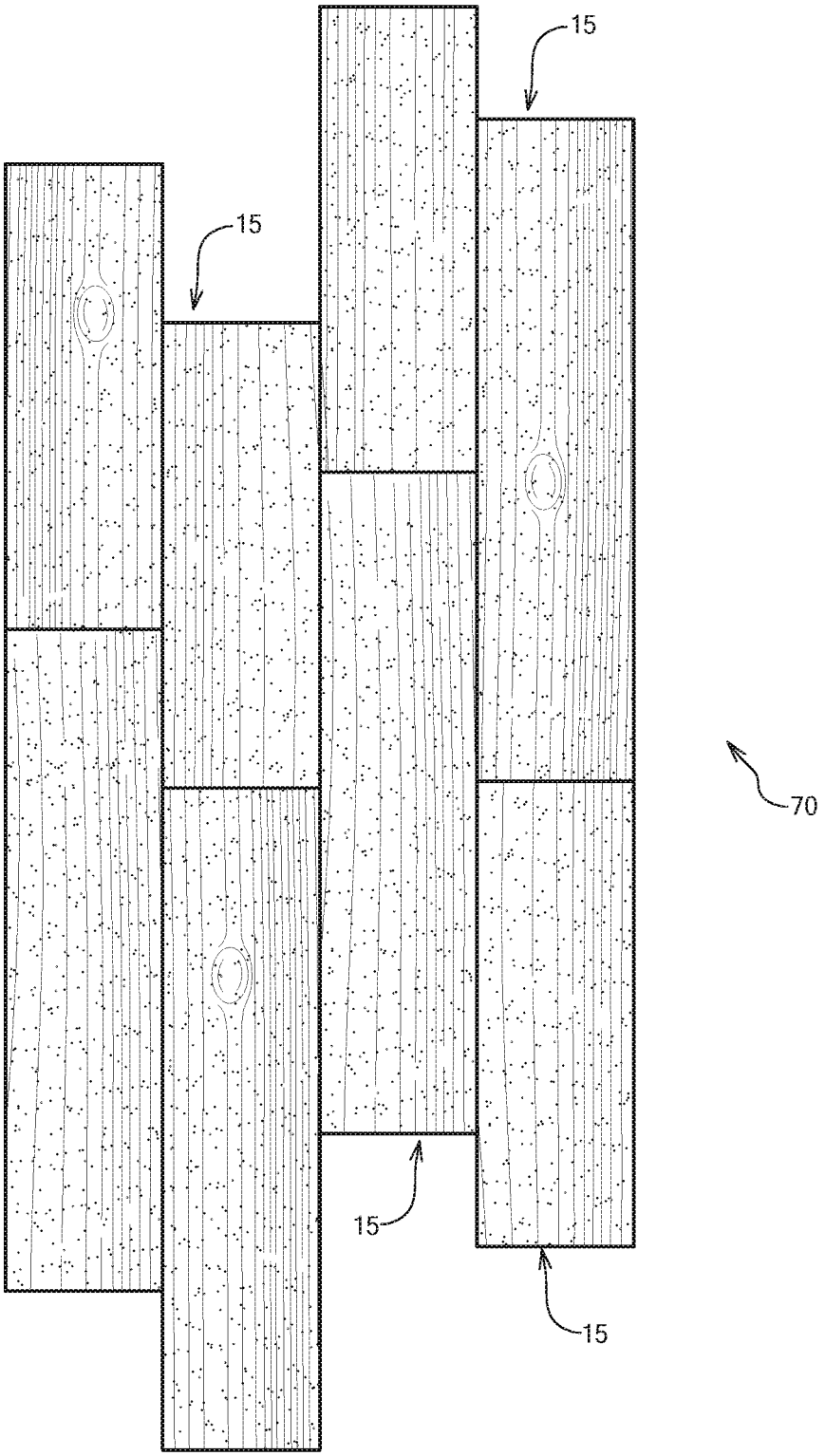
FIG. 20 is a front view of the enhanced plank of FIG. 18.
Figure 21:
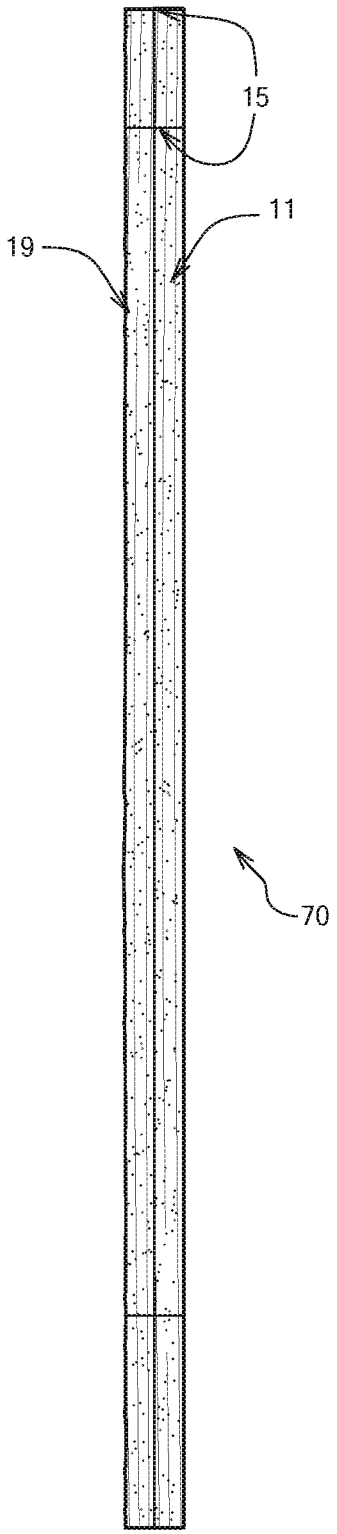
FIG. 21 is a left side view of the enhanced plank of FIG. 18.
Figure 22:
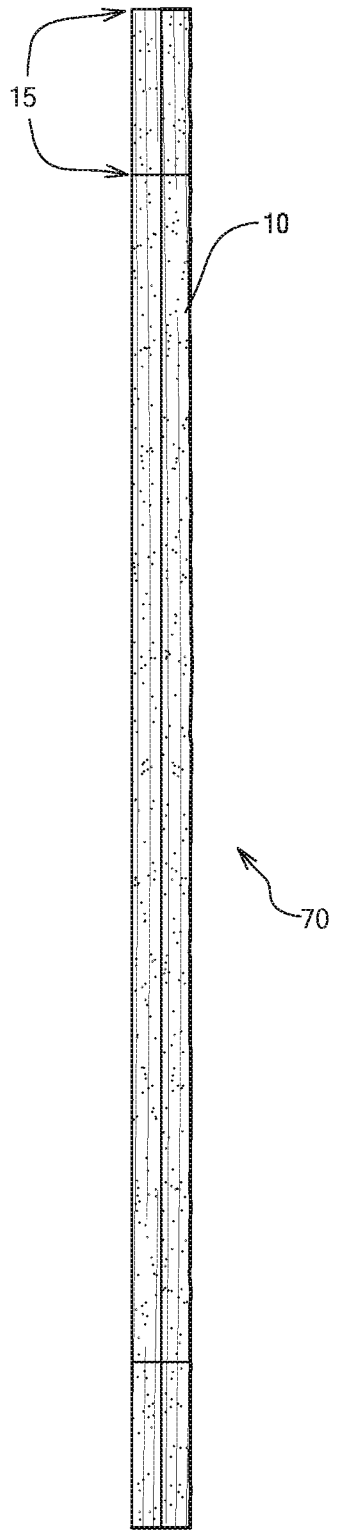
FIG. 22 is a right side view of the plank assembly of FIG. 18.
Figure 23:
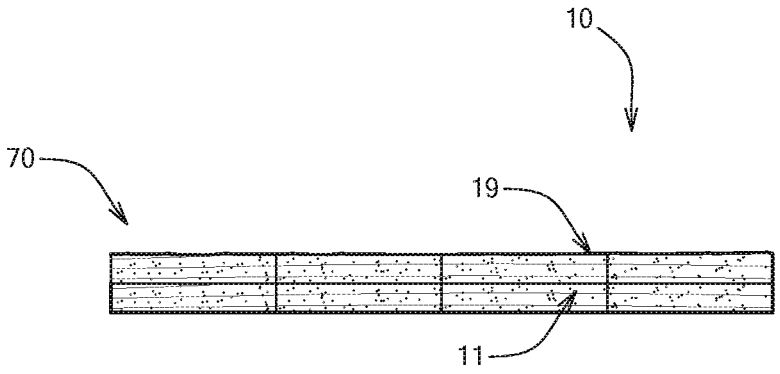
FIG. 23 is a top end view of the plank assembly of FIG. 18.
Figure 24:
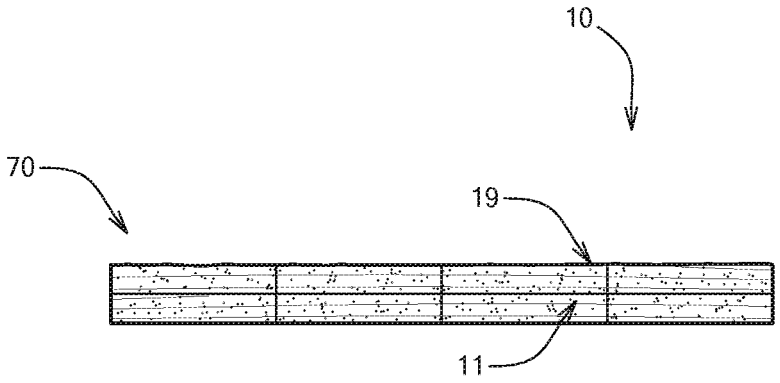
FIG. 24 is a bottom end view of the plank assembly of FIG. 18.
Figure 25:
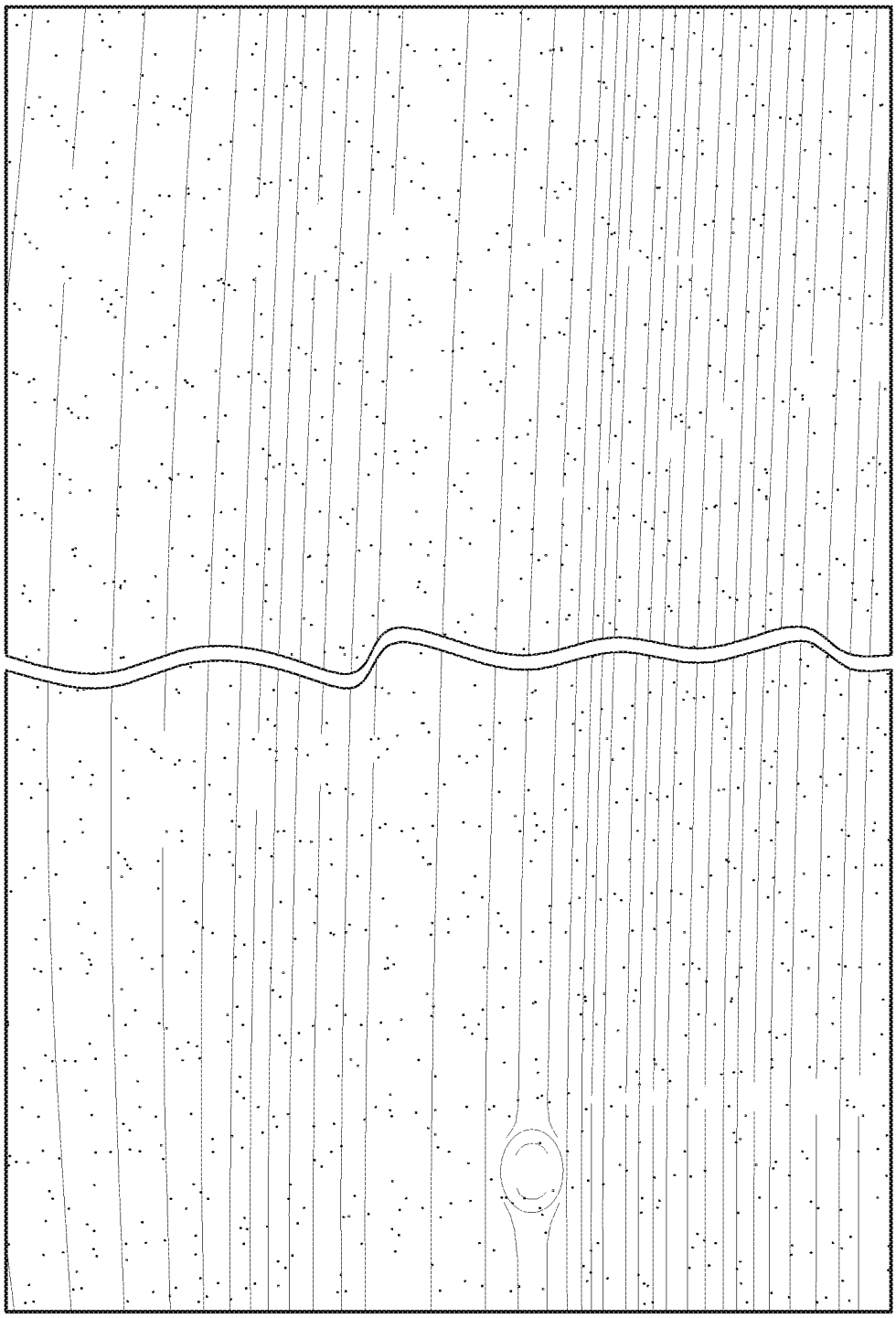
FIG. 25 is a front view of the plank assembly of FIG. 1.
Figure 26:
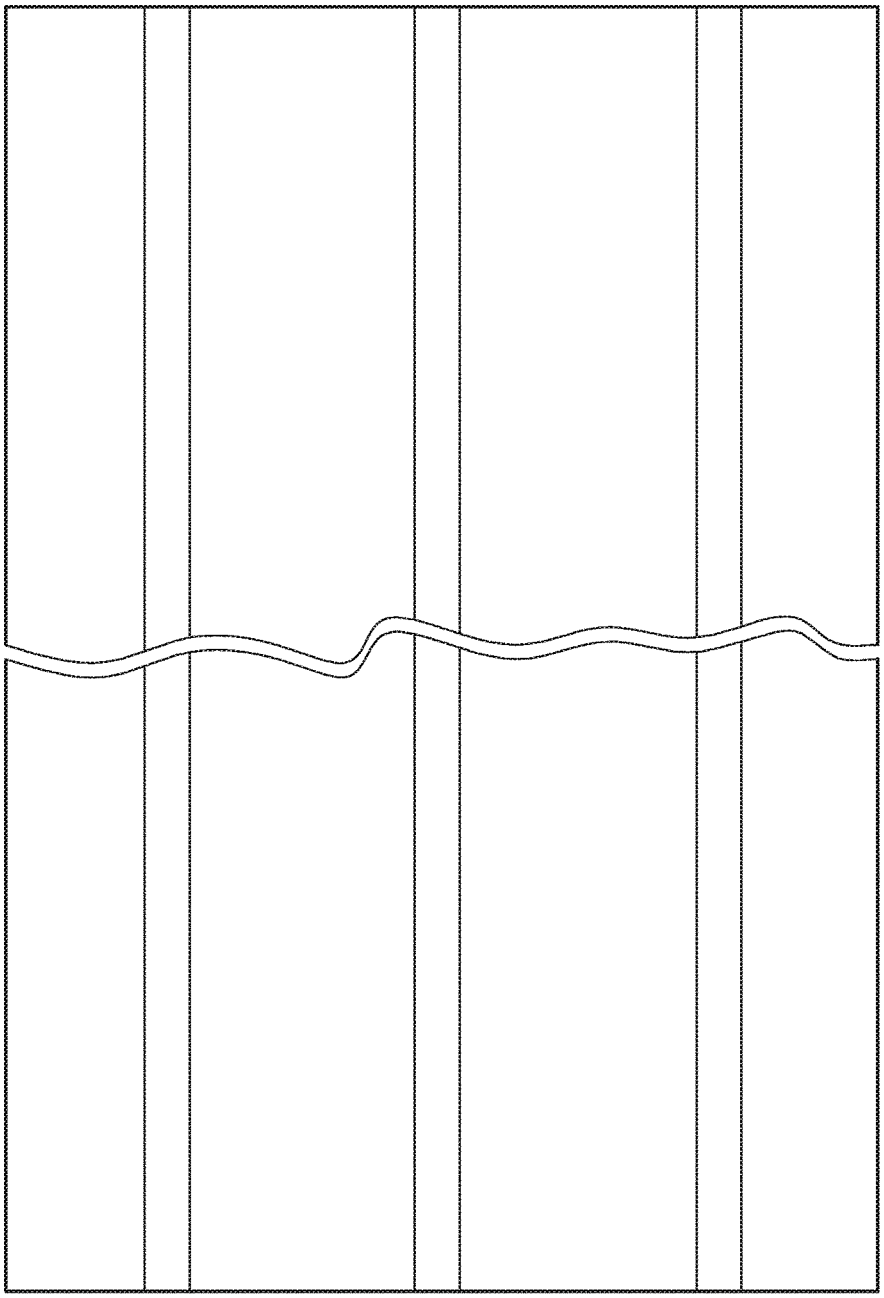
FIG. 26 is a back view of the plank assembly of FIG. 1.
Figure 27:
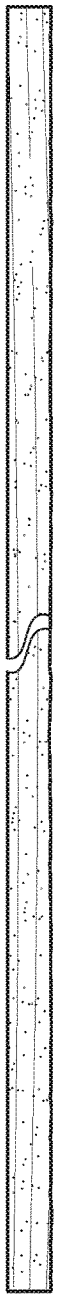
FIG. 27 is a side view of the plank assembly of FIG. 1.

The façade 11 of the enhanced plank 70 preferably visually appears to be multiple smaller segments, as shown in FIG. 20, for aesthetic reasons. The enhanced plank 70 may be cut from a single piece of material or may be a composite of multiple pieces of material. Whereas the plank 10 of the earlier embodiments had straight ends and straight lateral edges, the enhanced plank 70 may have irregular ends 15 (as shown) and/or irregular edges to enhance the aesthetic design and to obscure the plank edges.

In one aspect of the invention, the plank 10 is created from reclaimed lumber. In this aspect, the enhanced plank 70 may be fabricated with a single-piece back member 19 and with multiple smaller planks forming the front façade 11.

Figure 28:
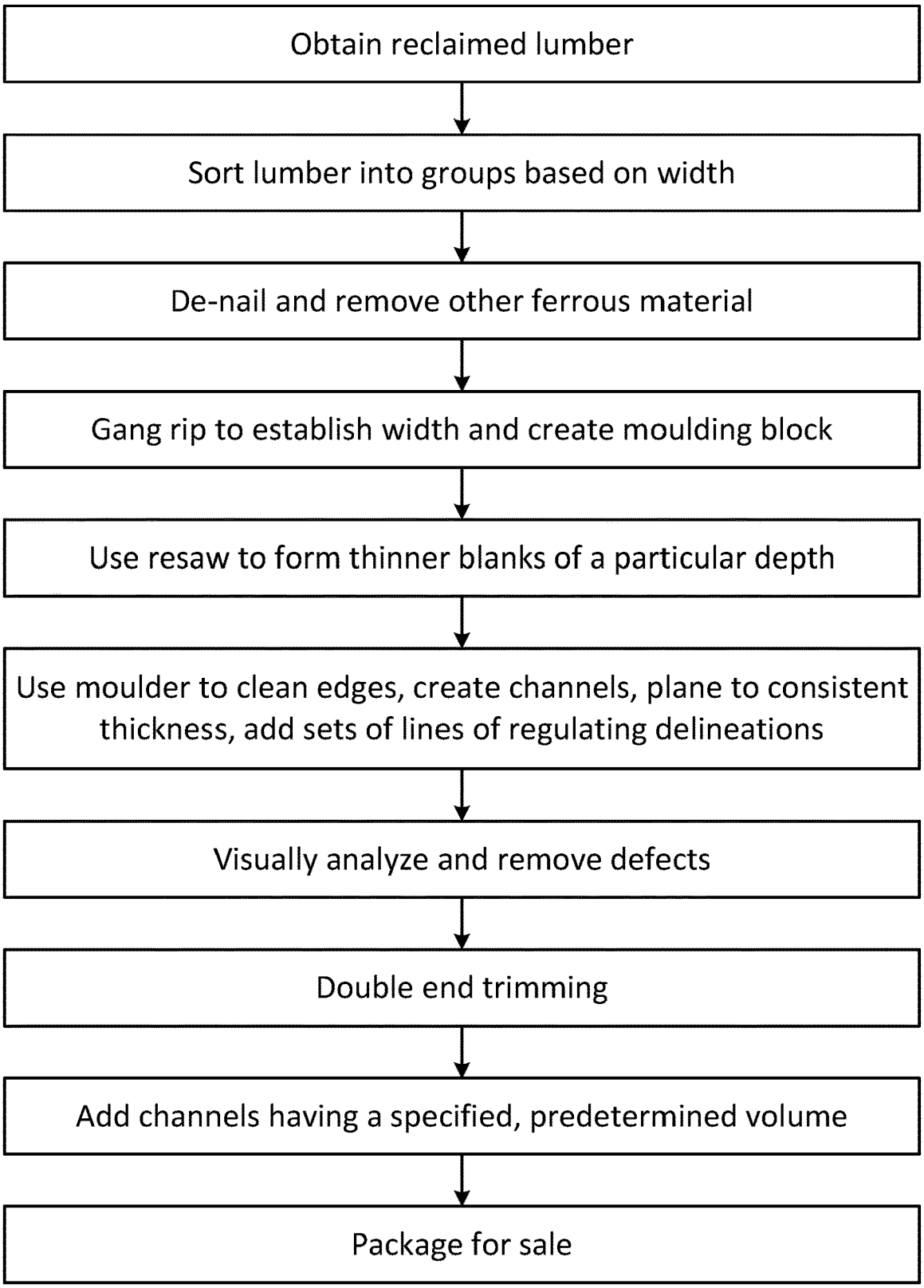
FIG. 28 is a flowchart showing steps in fabricating reclaimed wood planking of the present invention.

In a preferred aspect, the plank 10 of the wall or surface covering of the present invention is created from reclaimed lumber. An example of fabrication of the planks 10 from reclaimed lumber is shown in FIG. 28, which describes the creation of a 5-inch softwood reclaimed wood plank 10. In the first step, reclaimed lumber from an old building is obtained. The fabricator sorts the reclaimed lumber into width-filtered groupings based on the width at the smallest point of the lumber and selects lumber having at least a 5-inch width; the reclaimed lumber may have various random thicknesses. Then the fabricator de-nails the lumber and uses a metal detector to locate any remaining ferrous material, which is removed. The lumber may be shortened in length, if necessary, before processing through the mill.

The lumber is then dimensionalized by running the lumber through a gang rip. In one example, the width is ripped to 5.375 inches with the thickness remaining random, such as in the range of 0.6 inch to 1 inch. After the wood material is processed through the gang rip, it is referred to as a "moulding block."

The moulding block (having the width to which it was ripped and the original length) is processed through a resaw to create two thinner pieces or blanks. In an example, the resaw can be set to slice one side consistently at 0.313 inches to create a standard blank having a 0.313 inch-thickness and to simultaneously create a residual blank. Both the standard and residual blanks retain the length and width of the moulding block.

The standard blanks thus created are then processed through a moulder. The moulder cleans the edges while reducing the width to 5 inches, creates the channel sets 25, planes down the blanks into a consistent 0.25-inch thickness, and adds the sets of lines of regulating delineations 40 to form the reclaimed wood planks. At this stage, in the example, the planks have a thickness of 0.25 inches, have a width of 5 inches, and have random lengths.

Any knots, splits or blemishes that are not aesthetically pleasing are then defected (removed). Based on length, the planks are then separated into length-based groupings. Before packaging for commercial sale, the planks 10 are cut to the desired length by trimming both ends with a miter saw. In one aspect, this double end trim may be performed by trimming each end along one of the lines of regulating delineations 40 to provide a substantially 90-degree angle at each end.

After the double end trimming, multiple lanes or strips of double-sided pressure sensitive tape 50 are added to the plateaus 30 disposed between the channel sets 25 created by the moulder. The plank 10 is then placed into a pinch roller to apply pressure to the outer side of the tape to cause the reverse side of the tape to adhere well to the plateaus. For example, two lanes of 0.75 inch and two lanes of 0.5 inch of two-sided pressure sensitive tape may be applied along the length of four plateaus 30.

The planks are then packaged, preferably with varying lengths in one package. For example, a box sold as 18 square feet may consist of two 48-inch planks, four 36-inch planks, six 16-inch planks, and four 12-inch planks.

Figure 29:
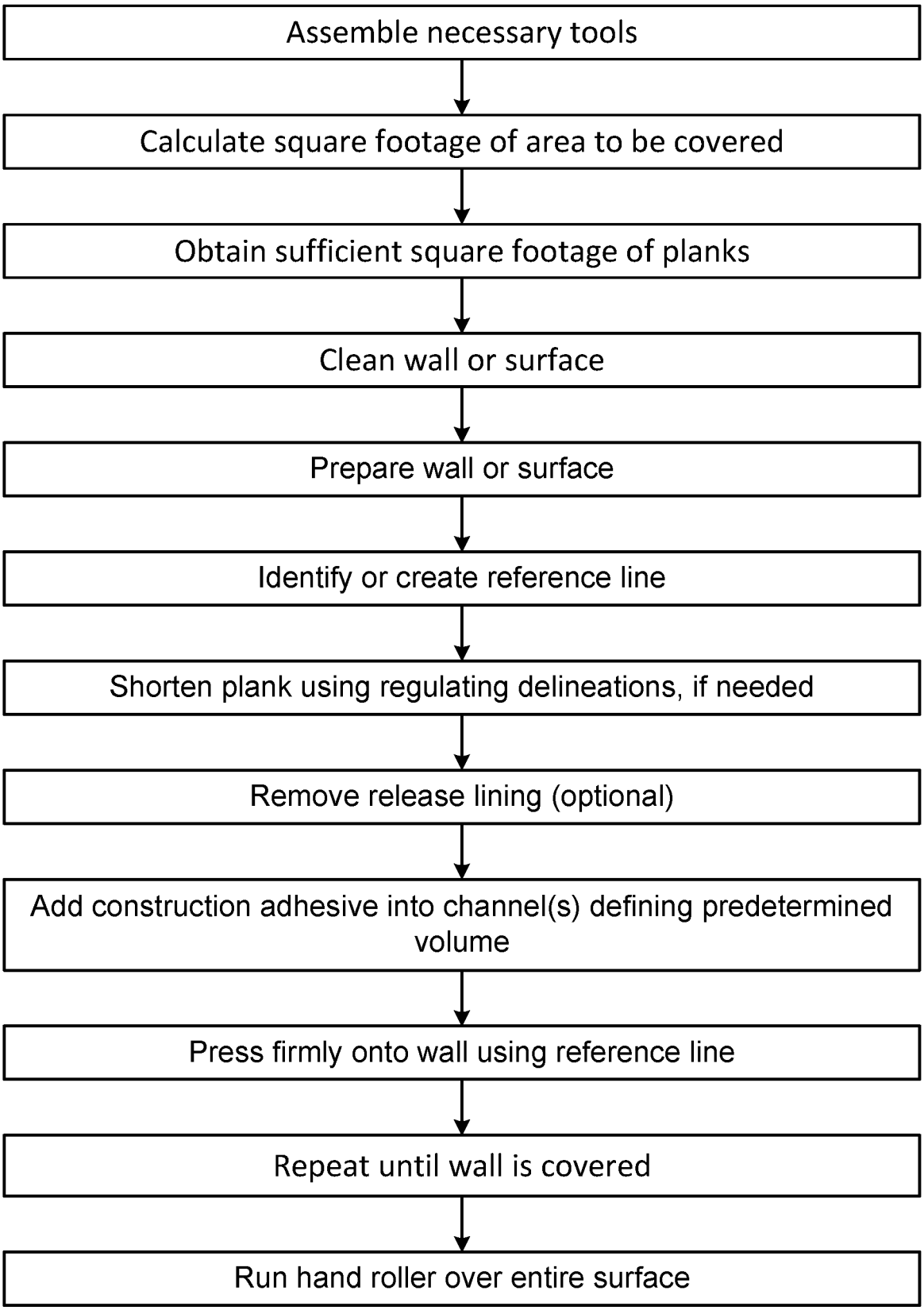
FIG. 29 is a flowchart showing the steps performed by an end user in utilizing the planks of the present invention.

In an exemplary method of installation, as seen in the flowchart of FIG. 29, the end user assembles the necessary tools for installation. These installation tools will generally include a measuring tape, a level, wet and dry rags (for preparing the wall for covering), a hammer or screwdriver (to remove nails or debris from the wall), a handsaw or electric saw, and a hand roller.

The end user then uses the measuring tape to measure the height and width of the surface to be covered by the plank paneling and calculates the square footage required by multiplying the height times the width. After the purchase of sufficient square footage of planks to cover the area, the user prepares the wall for application.

The wall or surface is then cleaned and dried. The end user removes all outlet plates, screws, nails, or other debris to create a smooth surface.

A reference line is then created. If the baseboard is level, it may be used as a reference line. Otherwise, a reference line is drawn on the wall using a level.

A bead of construction adhesive is spread into all the channels 20 of the back member 19 of the first plank 10 or into a designated subset of the channels 20. By use of the channels having a predetermined volume and location, the appropriate amount of adhesive is applied in a suitable location. The release liner, if included, is removed from the pressure-sensitive tape strips on the first plank. This first plank is placed in position along the reference line and pressed firmly against the wall. Additional planks are applied in the same manner, until a first row is completed. If a plank 10 is too long for the spot into which it must fit, it can be shortened with a hand saw or electric saw by using the regulating delineations 40.

When starting the second row of planks, the end user utilizes the first row as a reference line to start the next row. The user will stagger or offset the joint lines to create an aesthetically pleasing design. The rows are added in the same manner until the wall or other surface is covered. Then a hand roller is run over the entire surface to apply pressure to all the planks to ensure that the adhesive bonds well to the wall.

The invention illustratively disclosed herein suitably may be practiced in the absence of any element which is not specifically disclosed herein.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A decorative covering for a wall or surface comprising:

multiple planks, each plank of said multiple planks extending laterally between a first plank lateral edge and an opposing second plank lateral edge and extending longitudinally between a first plank end and an opposing second plank end; each plank of said multiple planks comprising:

a façade;

a plank back member opposing said façade; wherein said plank back member is configured with multiple separate channels interspersed within multiple plateaus; wherein each of said multiple separate channels has a predetermined volume defined by a width, length, and depth; wherein said predetermined volume accommodates a predetermined quantity of construction adhesive that is satisfactory for adhering said plank onto said wall or surface; wherein each of said multiple separate channels is disposed at a predetermined location; wherein said predetermined location is satisfactory for adhering said plank onto said wall or surface;

multiple pressure-sensitive adhesive strips, each of which is applied onto one of said multiple plateaus; and release lining applied to the underside of said multiple strips.

2. The decorative covering for a wall or surface, as recited in claim 1, each plank of said multiple planks further comprising:

a first set of multiple rows of regulating delineations disposed on said first plank end to facilitate shortening of said plank; and a second set of multiple rows of regulating delineations disposed on said second plank end to facilitate shortening of said plank.

3. The decorative covering for a wall or surface, as recited in claim 1, wherein said each of said multiple separate channels comprises an oval trough or a circular concavity.

4. The decorative covering for a wall or surface, as recited in claim 1, wherein said façade has a width less than the width of said plank back member; wherein said plank back member comprises a back member forward-facing section; and wherein, after installation of said plank, at least a portion of said back member forward-facing section is viewable and is not concealed by said façade.

5. A panel for use in covering a wall or surface comprising:

a plank extending laterally between a first plank lateral edge and an opposing second plank lateral edge and extending longitudinally between a first plank end and an opposing second plank end; said plank comprising:

a façade;

a plank back member opposing said façade; wherein said plank back member is configured with multiple separate channels interspersed within multiple plateaus; wherein each of said multiple separate channels has a predetermined volume defined by a width, length, and depth; wherein said predetermined volume accommodates a predetermined quantity of construction adhesive that is satisfactory for adhering said plank onto said wall or surface; wherein each of said multiple separate channels is disposed at a predetermined location; wherein said predetermined location is satisfactory for adhering said plank onto said wall or surface; and multiple pressure-sensitive adhesive strips, each of which is applied onto one of said multiple plateaus.

6. The panel for use in covering a wall or surface, as recited in claim 5, said plank further comprising:

a first set of multiple rows of regulating delineations disposed on said first plank end to facilitate shortening of said plank.

7. The panel for use in covering a wall or surface, as recited in claim 5, wherein said each of said multiple separate channels comprises an oval trough or a circular concavity.

8. The panel for use in covering a wall or surface, as recited in claim 7, wherein a first set of multiple rows of regulating delineations is disposed on said first plank end to facilitate shortening of said plank.

9. The panel for use in covering a wall or surface, as recited in claim 5, wherein said façade has a width less than the width of said plank back member; wherein said plank back member comprises a back member forward-facing section; and wherein, after installation of said plank, at least a portion of said back member forward-facing section is viewable and is not concealed by said façade.

* * * * *